US011458466B2

(12) United States Patent
Malvoisin

(10) Patent No.: US 11,458,466 B2
(45) Date of Patent: Oct. 4, 2022

(54) PIPETTE SYSTEM WITH INTERCHANGEABLE VOLUME COUNTER

(71) Applicant: Gilson S.A.S., Villiers-le-Bel (FR)

(72) Inventor: Hervé Malvoisin, Paris (FR)

(73) Assignee: Gilson S.A.S., Villiers-le-Bel (FR)

( * ) Notice: Subject to any disclaimer, the term of this patent is extended or adjusted under 35 U.S.C. 154(b) by 406 days.

(21) Appl. No.: 15/931,050

(22) Filed: May 13, 2020

(65) Prior Publication Data

US 2020/0360917 A1 Nov. 19, 2020

Related U.S. Application Data

(60) Provisional application No. 62/847,720, filed on May 14, 2019.

(51) Int. Cl.
*B01L 3/02* (2006.01)

(52) U.S. Cl.
CPC ..... *B01L 3/0224* (2013.01); *B01L 2200/12* (2013.01); *B01L 2400/0487* (2013.01)

(58) Field of Classification Search
CPC ..... B01L 3/0224; B01L 2200/12; B01L 2400/0487; B01L 3/0279
See application file for complete search history.

(56) References Cited

U.S. PATENT DOCUMENTS

| | | | | |
|---|---|---|---|---|
| 5,531,131 | A * | 7/1996 | Sabloewski | B01L 3/0224 73/864.18 |
| 7,373,848 | B2 * | 5/2008 | Viot | B01L 3/0224 73/864.16 |
| 9,630,174 | B2 * | 4/2017 | Sarna | B01L 3/0224 |
| 9,931,628 | B2 * | 4/2018 | LaCroix | B01L 3/0224 |
| 10,744,498 | B2 * | 8/2020 | Schiraga | B01L 3/0224 |
| 10,751,712 | B2 * | 8/2020 | Schiraga | B01L 3/0227 |
| 11,364,491 | B2 * | 6/2022 | Malvoisin | B01L 3/0224 |
| 2005/0118069 | A1 * | 6/2005 | Solotareff | B01L 3/0237 436/180 |
| 2016/0303557 | A1 * | 10/2016 | LaCroix | B01L 3/0224 |
| 2019/0083969 | A1 * | 3/2019 | Schiraga | F16H 63/18 |
| 2021/0046471 | A1 * | 2/2021 | Molitor | B01L 3/0224 |
| 2021/0346883 | A1 * | 11/2021 | Kneucker | B01L 3/0227 |

* cited by examiner

*Primary Examiner* — Freddie Kirkland, III
(74) *Attorney, Agent, or Firm* — Quarles & Brady LLP

(57) ABSTRACT

This disclosure concerns a pipette system with an interchangeable volume counter. Aspects of the pipette body design and external dimensions allow various functional features of the pipette system, and, thus, various interior adjustment part designs and dimensions, to be accommodated in a single pipette body design. A three-digit volume counter, a four-digit volume counter, or an electronic counter can be installed in the same pipette body design.

20 Claims, 20 Drawing Sheets

PIPETTE SYSTEM WITH INTERCHANGEABLE VOLUME COUNTER

CROSS REFERENCE TO RELATED APPLICATIONS

This application claims the benefit of U.S. Patent Application No. 62/847,720, filed on May 14, 2019, and entitled "PIPETTE SYSTEM WITH INTERCHANGEABLE VOLUME COUNTER," the entire contents of which is incorporated by reference herein in its entirety.

REFERENCE REGARDING FEDERALLY SPONSORED RESEARCH OR DEVELOPMENT

Not applicable.

SEQUENTIAL LISTING

Not applicable.

BACKGROUND

1. Field of the Disclosure

The present disclosure relates to the field of pipetting systems such as manual pipetting systems (e.g., single-channel or multichannel sampling pipettes, also referred to as laboratory pipettes, or even air-displacement liquid transfer pipettes) intended for the sampling and calibrated introduction of liquid into receptacles. These types of pipettes, whether they are manual, motorized, or a combination of the two, are intended to be held in the hand by an operator during the sampling and dispensing operations of liquid.

2. Description of the Background of the Disclosure

Conventional pipettes are provided with a sampling volume adjustment screw, which is controlled in rotation by a pipette control button, via a control shaft that connects the button to the volume adjustment screw. Pipettes of the types disclosed herein are very precise devices that require specific and fine-tuned tolerances during the manufacture thereof, which can increase time and costs to manufacture. Historically, such pipettes have been subject to minimal customization by an end user due to the difficulties of modifying various components for inclusion in multiple pipette systems.

When the pipette comprises a counter designed to display very precise volume values, for example a three-figure or four-figure counter, adjustment of the pipette to a given value may sometimes prove to be challenging. Sometimes, the last digit in four-figure counters are associated with a drum that can rotate faster than the pipette control button activated by the operator, hence the difficulty of obtaining the precise value desired. Thus, depending on the counter used in the pipette system, the interior parts of the pipette system may differ to address problems unique to each specific counter. Further, some pipette designs include an internal lever system to improve pipette tip ejection or include other interior adjustment parts that provide a variety of volume adjustment settings, such as free adjustment, fine adjustment, and locked.

The interior adjustment part dimensions can vary depending on the functional features included with a particular pipette, such as those noted above. In many instances, the housing is adapted to accept the different adjustment part dimensions, and therefore, conventional pipettes can have varying external geometries designed to accommodate the differences in internal configurations. As a result, in some prior art systems, inclusion of multiple functional features in a pipette may result in a larger housing being required to accommodate the features.

Therefore, in prior art systems, the design parameters for three-figure or four-figure counters are different and can lead to extra cost and waste for manufacturers by having to produce a number of different pipette housings to accommodate the counters and the associated components. The housing shape and size differences also create discontinuity of the exterior design and of other features contributing to ergonomic design benefits, which may lead to user discomfort or stress when switching between pipettes having different functional features.

SUMMARY

To address this problem, it would be desirable to have a pipette system with a uniform housing that is designed to accommodate a variety of configurations of the pipette system to reduce manufacturing costs and to maintain a uniform look and feel for the end user.

According to one aspect, a pipette system for transporting a measured volume of liquid is provided. The pipette system includes a body including a housing defining an interior space, and an elongate opening positioned in a front wall of the housing. The interior space is configured to receive one of a plurality of volume counters without modification of the housing, and the plurality of volume counters includes a first counter and a second counter different than the first counter.

In some embodiments, the pipette system includes a hook, and the hook extends away from a central axis of the housing at a radius of curvature configured to rest on an index finger of a user during use. The housing has a widest cross-section, and the widest cross-section of the housing can be between about 2.9 and about 3.2 times a length of the radius of curvature of the hook. The pipette system can include a control button coupled to a control shaft that extends away from a control end of the housing and the widest cross-section of the housing can be between about 0.9 and about 1.2 times a distance from the control end of the housing to a top of the control button. The pipette system can include an ejector coupled to the housing opposite the opening positioned in the front wall of the housing, and the widest cross-section of the housing can be between about 1.9 and about 2.1 times a distance from a central axis of the ejector to a central axis of the control button. In some embodiments, the distance from the control end of the housing to a top of the control button is between about 1.8 and about 2.4 times a distance from a central axis of the ejector to a central axis of the control button.

In some embodiments, the housing has a widest cross-section and the housing forms a hook, the hook extending away from a central axis of the housing at a radius of curvature. The pipette system can further include a control button coupled to a control shaft that extends away from a control end of the housing and an ejector coupled to the housing opposite the opening. The widest cross-section can be between 2 and 3 times a length of the radius of curvature of the hook. A distance from the control end of the housing to a top of the control button can be between 2 and 4 times the length of the radius of curvature of the hook, and a distance from a central axis of the ejector to a central axis of the control button can be between 1 and 2 times the length of the radius of curvature of the hook.

In some embodiments, the opening can be configured to receive and retain a plurality of window guides by an interference fit. The plurality of window guides can include a first window guide and a second window guide. The first window guide can have a hollow center that corresponds to a first in-use configuration and the second window guide can have a window and correspond to a second in-use configuration different than the first in-use configuration. The hollow center can at least partially reveal the first counter in the first in-use configuration and the window can at least partially reveal the second counter in the second in-use configuration.

In some embodiments, the first counter has a first number of digits and the second counter has a second number of digits different than the first number of digits. The first number of digits can be three and the second number of digits can be four, the first counter including an insertable spacer and the first counter designed to mechanically attach to the insertable spacer. The first counter can correspond to a first set of interior adjustment parts, the second counter can correspond to a second set of interior adjustment parts different than the first set of interior adjustment parts, and the interior space of the housing can have a size, shape, and volume to interchangeably retain the first set of interior adjustment parts or the second set of interior adjustment parts without modification of an exterior portion of the housing. The first counter can correspond to a first in use configuration and the second counter can correspond to a second in use configuration different than the first in use configuration.

In some embodiments, the body includes a lever. The lever can contact an ejector and the lever can be movably coupled to an interior adjustment part. The pipette system can include an adjustment feature controlled by a selector control button and is configured to provide a plurality of adjustment mechanisms. The selector control button can provide adjustment positions including one or more of a free adjustment position, a fine adjustment position, and a latched position.

According to one aspect, a body of a pipette system for transporting a measured volume of liquid is provided. The body includes a housing defining an interior space and an opening positioned on a front wall of the housing. The interior space can be dimensioned to receive a first volume counter having three-digits and a second volume counter having four-digits, without modification of the housing. The first counter can include an insertable spacer and the insertable spacer can be designed to mechanically attach to the first counter. The volume of the first counter and the spacer can be substantially equal to the volume of the second counter.

In some embodiments, a method of manufacturing a pipette system includes the steps of providing a housing that is configured to receive a first volume counter or a second volume counter, the first volume counter being different than the second volume counter, providing a first set of interior adjustment parts that is configured to be coupled with the first volume counter or providing a second set of interior adjustment parts that is configured to be coupled with the second volume counter, assembling the first set of interior adjustment parts or the second set of interior adjustment parts within the housing, and inserting the first volume counter or the second volume counter into a cavity defined by the housing.

In some embodiments, the method further includes the step of inserting a spacer into an interior space of the housing before inserting the first volume counter into the cavity. In some embodiments, the method further includes the step of providing an ejector system with the housing, the ejector system including an ejection lever. In some embodiments, the first set of interior adjustment parts are only configured to be coupled with the first volume counter, and the second set of interior adjustment parts are only configured to be coupled with the second volume counter. In some embodiments, the first volume counter has a first number of digits and the second volume counter has a second number of digits different than the first number of digits.

In some embodiments, the second volume counter is larger in size than the first volume counter. In some embodiments, the first set of interior adjustment parts are configured to be coupled with the first volume counter or with the second volume counter. In some embodiments, the housing interchangeably retains the first set of interior adjustment parts or the second set of interior adjustment parts without modification of an exterior of the housing. In some embodiments, the opening is configured to receive and retain a first window guide or a second window guide that is different than the first window guide. In some embodiments, the method further includes the step of providing a position selector that is displaced in rotation among at least three positions, and the position selector is one of the first or second interior adjustment parts.

According to a different aspect, a kit for assembling a pipette system includes a body including a housing defining an interior space, the body defining a housing with an elongate opening positioned in a front wall of the housing, a first volume counter configured to be inserted into the body or a second volume counter configured to be inserted into the body, and a first set of interior adjustment parts configured to be coupled with the first volume counter or a second set of interior adjustment parts configured to be coupled with the second volume counter. The opening is configured to receive the first volume counter into the interior space or the second volume counter into the interior space without modification of the housing.

In some embodiments, the first volume counter has a first number of digits and the second volume counter has a second number of digits different than the first number of digits. In some embodiments, the kit further includes a spacer configured to be coupled with the first volume counter. In some embodiments, the volume of the first volume counter and the spacer is substantially equal to the volume of the second volume counter. In some embodiments, each of the first volume counter and the second volume counter are configured to be inserted into the interior space of the body and adjacent the elongate opening without modification to the housing. In some embodiments, the kit further includes an ejector system with the housing, the ejector system being configured for coupling with the body. In some embodiments, the ejector system includes a lever. In some embodiments, the elongate opening is configured to receive and retain a first window guide or a second window guide that is different than the first window guide. In some embodiments, the kit further includes a position selector that is displaced in rotation among at least three positions, and the position selector is one of the first or second interior adjustment parts. In some embodiments, the housing includes a hook, the hook extending away from a central axis of the housing at a radius of curvature configured to rest on an index finger of a user during an in-use configuration.

According to a different aspect, a method of manufacturing and assembling a pipette system for transporting a measured volume of liquid is provided. The method can include the step of receiving a housing for a pipette system, the housing defining an interior space and a hook. The hook extends away from a central axis of the housing at a radius of curvature, and the interior space is dimensioned to receive a plurality of different volume counters having either three-digits or four-digits.

According to one aspect, a pipette system for transporting a measured volume of liquid is provided. The pipette system includes a body having a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter.

According to another aspect, a pipette system for transporting a measured volume of liquid is provided. The pipette system includes a body having a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes a three-digit counter and a rounded control button coupled to a control shaft that extends away from a control end of the housing. The rounded control button can include an electronic device configured to wirelessly transmit signals by wireless link.

According to a further aspect, a pipette system for transporting a measured volume of liquid is provided. The pipette system comprises a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes a three-digit counter and a rounded control button coupled to a control shaft that extends away from a control end of the housing. The pipette system includes an ejection system with an added assist, including a lever.

According to one aspect, a pipette system for transporting a measured volume of liquid is provided. The pipette system including a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes a three-digit counter and a rounded control button coupled to a control shaft that extends away from a control end of the housing. The pipette system includes an adjustment feature controlled by a selector control button and is configured to provide a plurality of adjustment mechanisms.

According to one aspect, a pipette system for transporting a measured volume of liquid is provided. The pipette system comprising a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes a three-digit counter and a rounded control button coupled to a control shaft that extends away from a control end of the housing. The pipette system includes an ejection system with an added assist, including a lever and an adjustment feature controlled by a selector control button, and is configured to provide a plurality of adjustment mechanisms According to a different aspect, a pipette system for transporting a measured volume of liquid is provided. The pipette system includes a body having a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes a three-digit counter and a control button coupled to a control shaft that extends away from a control end of the housing.

According to one aspect, a pipette system for transporting a measured volume of liquid is provided, the pipette system is provided in the form of a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes a three-digit counter and a flat control button coupled to a control shaft that extends away from a control end of the housing. The pipette system includes an ejection system with an added assist, including a lever.

According to another aspect, a pipette system for transporting a measured volume of liquid is provided. The pipette system includes a body having a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes a three-digit counter and a flat control button coupled to a control shaft that extends away from a control end of the housing. The pipette system includes an adjustment feature controlled by a selector control button, configured to provide a plurality of adjustment mechanisms.

According to a further aspect, a pipette system for transporting a measured volume of liquid is provided. The pipette system includes a body having a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes a three-digit counter and a flat control button coupled to a control shaft that extends away from a control end of the housing. The pipette system includes an ejection system with an added assist, including a lever and an adjustment feature controlled by a selector control button, configured to provide a plurality of adjustment mechanisms According to one aspect, a pipette system for transporting a measured volume of liquid is provided. The pipette system comprising a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes a four-digit counter and a rounded control button coupled to a control shaft that extends away from a control end of the housing. The rounded control button can include an electronic device configured to wirelessly transmit signals by wireless link.

According to one aspect, a pipette system for transporting a measured volume of liquid is provided. The pipette system has a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes a four-digit counter and a rounded control button coupled to a control shaft that extends away from a control end of the housing. The pipette system includes an ejection system with an added assist, including a lever.

According to one aspect, a pipette system for transporting a measured volume of liquid is provided. The pipette system having a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes a four-digit counter and a rounded control button coupled to a control shaft that extends away from a control end of the housing. The pipette system includes an adjustment feature controlled by a selector control button, configured to provide a plurality of adjustment mechanisms.

According to one aspect, a pipette system for transporting a measured volume of liquid is provided. The pipette system comprising a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes a four-digit counter and a rounded control button coupled to a control shaft that extends away from a control end of the housing. The pipette system includes an ejection system with an added assist, including a lever and an adjustment feature controlled by a selector control button, and is configured to provide a plurality of adjustment mechanisms According to one aspect, a pipette system for transporting a measured volume of liquid is provided. The pipette system having a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes a four-digit counter and a control button coupled to a control shaft that extends away from a control end of the housing.

According to one aspect, a pipette system for transporting a measured volume of liquid is provided. The pipette system having a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes a four-digit counter and a flat control button coupled to a control shaft that extends away from a control end of the housing. The pipette system includes an ejection system with an added assist, including a lever.

According to one aspect, a pipette system for transporting a measured volume of liquid is provided. The pipette system having a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes a four-digit counter and a flat control button coupled to a control shaft that extends away from a control end of the housing. The pipette system includes an adjustment feature controlled by a selector control button, and is configured to provide a plurality of adjustment mechanisms.

According to one aspect, a pipette system for transporting a measured volume of liquid is provided. The pipette system having a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes a four-digit counter and a flat control button coupled to a control shaft that extends away from a control end of the housing. The pipette system includes an ejection system with an added assist, including a lever and an adjustment feature controlled by a selector control button, configured to provide a plurality of adjustment mechanisms According to one aspect, a pipette system for transporting a measured volume of liquid is provided. The pipette system having a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes an electronic counter and a rounded control button coupled to a control shaft that extends away from a control end of the housing. The rounded control button can include an electronic device configured to wirelessly transmit signals by wireless link.

According to one aspect, a pipette system for transporting a measured volume of liquid is provided. The pipette system having a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes an electronic counter and a rounded control button coupled to a control shaft that extends away from a control end of the housing. The pipette system includes an ejection system with an added assist, including a lever.

According to one aspect, a pipette system for transporting a measured volume of liquid is provided. The pipette system having a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes an electronic counter and a rounded control button coupled to a control shaft that extends away from a control end of the housing. The pipette system includes an adjustment feature controlled by a selector control button, configured to provide a plurality of adjustment mechanisms.

According to one aspect, a pipette system for transporting a measured volume of liquid is provided. The pipette system having a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes an electronic counter and a rounded control button coupled to a control shaft that extends away from a control end of the housing. The pipette system includes an ejection system with an added assist, including a lever and an adjustment feature controlled by a selector control button, configured to provide a plurality of adjustment mechanisms According to one aspect, a pipette system for transporting a measured volume of liquid is provided. The pipette system having a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes an electronic counter and a control button coupled to a control shaft that extends away from a control end of the housing.

According to one aspect, a pipette system for transporting a measured volume of liquid is provided. The pipette system having a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes an electronic counter and a flat control button coupled to a control shaft that extends away from a control end of the housing. The pipette system includes an ejection system with an added assist, including a lever.

According to one aspect, a pipette system for transporting a measured volume of liquid is provided. The pipette system having a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes an electronic counter and a flat control button coupled to a control shaft that extends away from a control end of the housing. The pipette system includes an adjustment feature controlled by a selector control button, configured to provide a plurality of adjustment mechanisms.

According to one aspect, a pipette system for transporting a measured volume of liquid is provided. The pipette system having a body including a housing defining an interior space, and an elongate opening positioned in a front wall of the housing. The interior space is dimensioned to receive a plurality of volume counters, and the plurality of volume counters includes a first counter, a second counter different than the first counter, and a third counter different than the second counter and the first counter. The pipette system includes an electronic counter and a flat control button coupled to a control shaft that extends away from a control end of the housing. The pipette system includes an ejection system with an added assist, including a lever and an adjustment feature controlled by a selector control button, configured to provide a plurality of adjustment mechanisms.

BRIEF DESCRIPTION OF THE DRAWINGS

Other aspects and advantages of the present disclosure will become apparent upon consideration of the following detailed description, wherein similar structures have similar reference numerals.

DETAILED DESCRIPTION OF THE DRAWINGS

Figure 1:
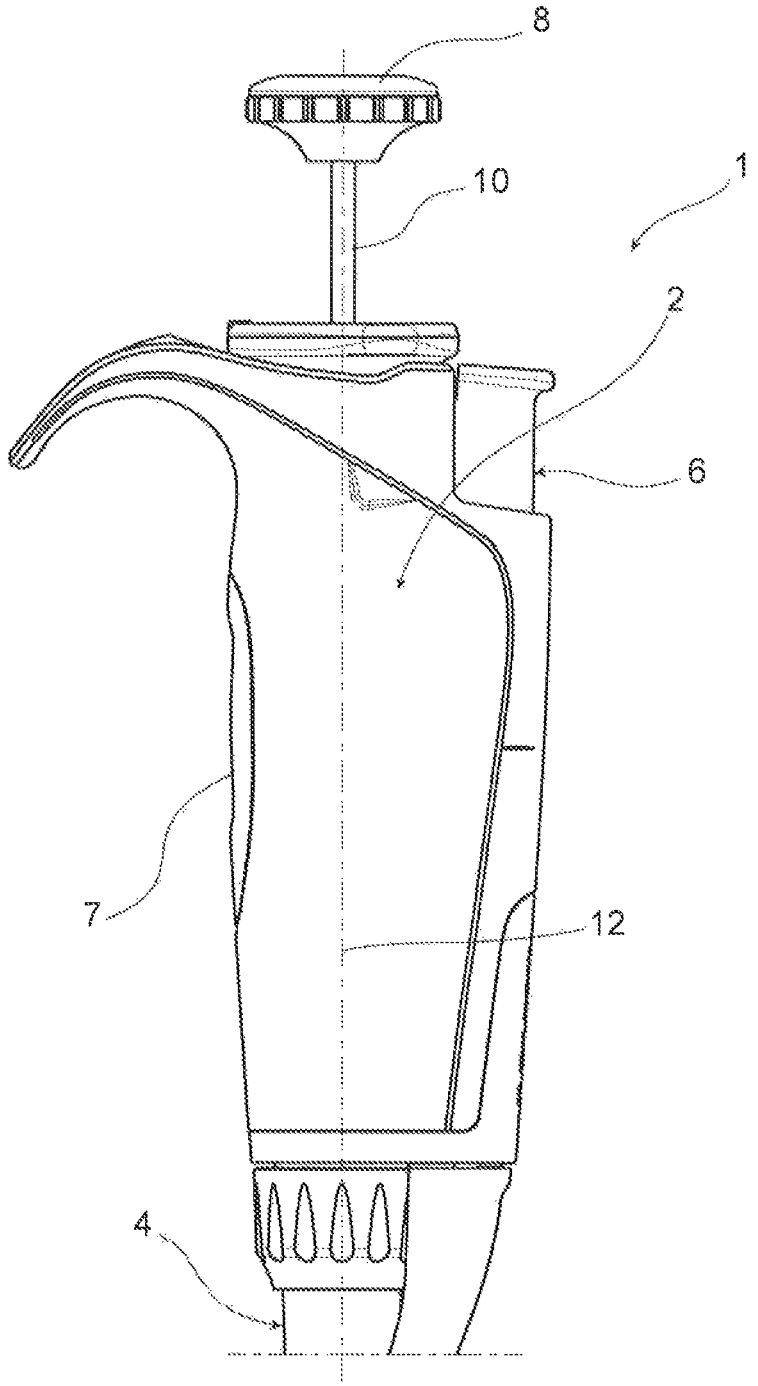
FIG. 1 shows a side elevational view of a pipette, according to one embodiment.

The following discussion is presented to enable a person skilled in the art to make and use embodiments of the disclosure. Various modifications to the illustrated embodiments will be readily apparent to those skilled in the art, and the generic principles herein can be applied to other embodiments and applications without departing from embodiments of the disclosure. Thus, embodiments of the disclosure are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the disclosure. Skilled artisans will recognize the examples provided herein have many useful alternatives and fall within the scope of embodiments of the disclosure.

It is to be understood that the phraseology and terminology used herein is for the purpose of description and should not be regarded as limiting. For example, the use of "including," "comprising," or "having" and variations thereof herein is meant to encompass the items listed thereafter and equivalents thereof as well as additional items.

As used herein, unless otherwise specified or limited, the terms "mounted," "connected," "supported," "secured," and "coupled" and variations thereof, as used with reference to physical connections, are used broadly and encompass both direct and indirect mountings, connections, supports, and couplings. Further, unless otherwise specified or limited, "connected," "attached," or "coupled" are not restricted to physical or mechanical connections, attachments or couplings.

As used herein, unless otherwise specified or limited, "at least one of A, B, and C," and similar other phrases, are meant to indicate A, or B, or C, or any combination of A, B, and/or C. As such, this phrase, and similar other phrases can include single or multiple instances of A, B, and/or C, and, in the case that any of A, B, and/or C indicates a category of elements, single or multiple instances of any of the elements of the categories A, B, and/or C."

As discussed above, pipette systems can include a number of different functional features to aid in the measurement and transfer of liquid. For example, pipette systems can include a counter designed to alert the user as to how much liquid is being transferred. For example, in some instances, a three or a four-digit counter may be used depending on the desired reading accuracy of liquid transfer. In other instances, an electronic counter may be used and may include, for example, one or more of a microprocessor, brushes, a coder, liquid crystal screen and electronic circuit such as in the pipette described in U.S. Pat. No. 7,373,848, which is incorporated by reference herein in its entirety. Pipette systems may also include one or more of internal levers to lower the required pipette tip ejection force, or adjustable locking mechanisms to lock the transfer volume selected by the user. Because different pipette functionalities require different interior adjustment parts having unique dimensions and space requirements, it can be useful to provide a more universalized pipette body that is capable of accommodating many different combinations of interior adjustment part dimensions arising from different combinations of pipette functionalities. Further, by providing a universalized body design, users can rely on the continuity of ergonomic feel of the pipettes being used, regardless of the functionalities associated with a particular pipette. Also, manufactures can benefit from being able to assemble pipettes having different functionalities using one universalized pipette body. Embodiments described herein provide these and other benefits.

FIG. 1 depicts a manual, single-channel sampling pipette 1 according to an embodiment of the disclosure. However, the disclosure is not limited to such a pipette, rather it can be applied in a similar manner to multi-channel pipettes or to any other pipetting system, including systems that are manual, motorized, or hybrid.

The pipette 1, shown here in its manual version, comprises in its upper part a body forming a handle 2, as well as a lower part 4 intended to include, at its lower end, a sampling cone-mounting tip (not shown). The tip is provided to accommodate a cone, which is disposable and is intended to be ejected from the end by an ejection system 6 once the pipetting operations have been completed.

Figure 2:
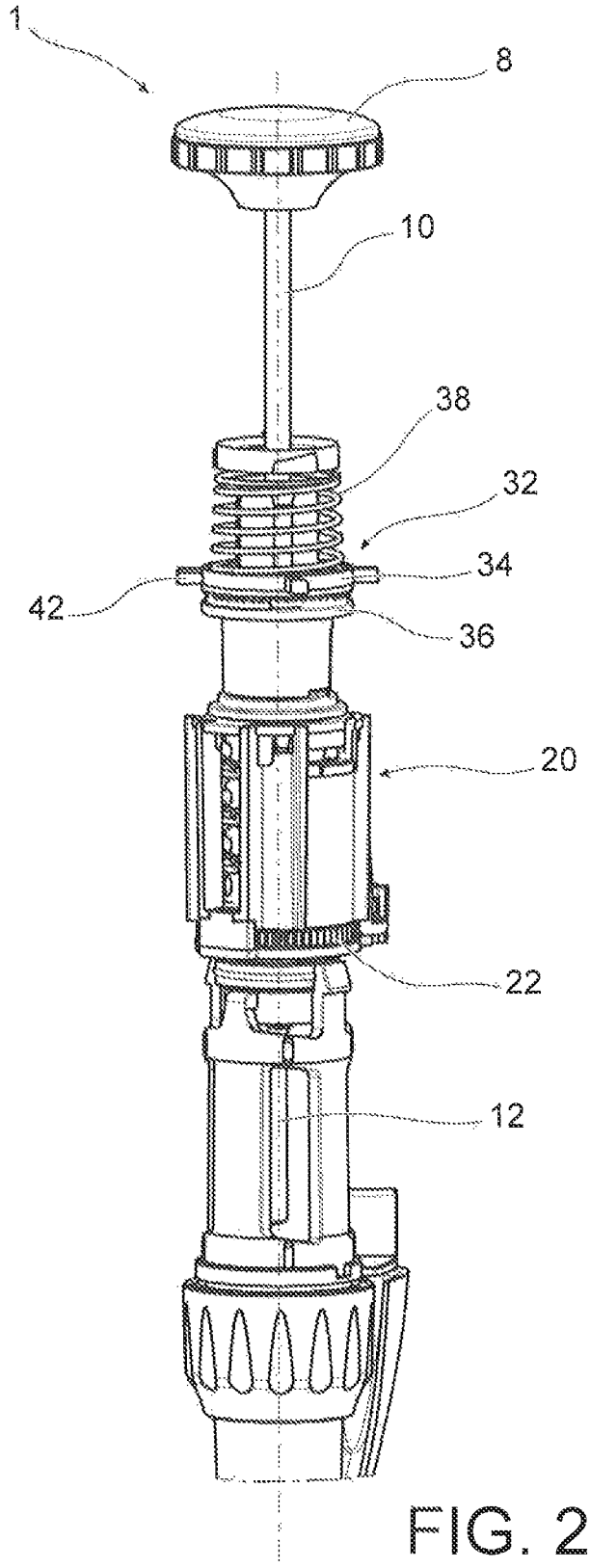
FIG. 2 shows an isometric view of a portion of the pipette of FIG. 1, including a latching device of a volume adjustment screw.
Figure 3:
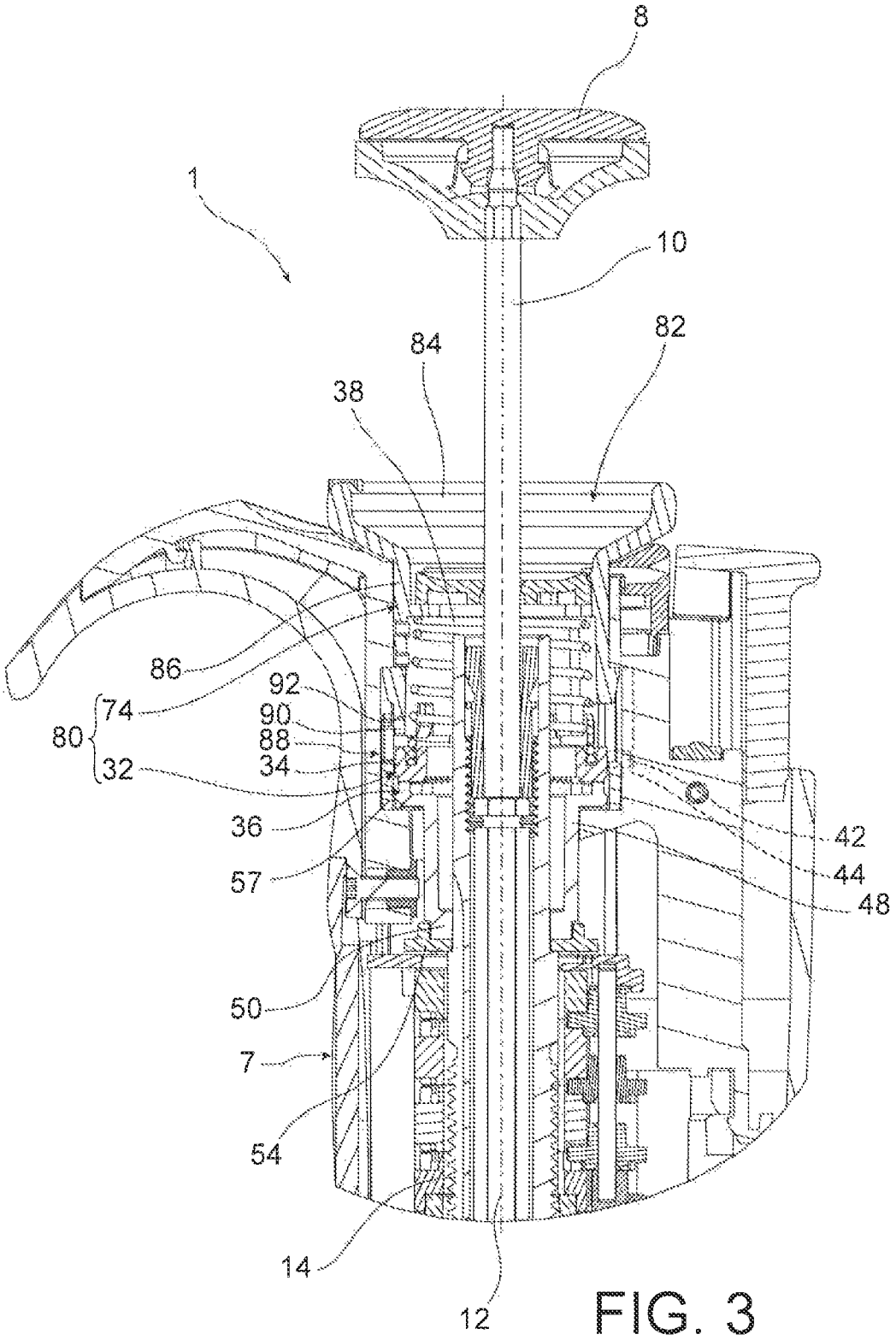
FIG. 3 shows a cross-sectional view of an upper part of the pipette of FIG. 1.

As shown in FIGS. 1-3, the pipette 1 comprises a control button 8 designed to be activated by an operator's thumb, in order to perform the various pipetting operations such as the sampling and dispensing of liquid. The control button 8 is mounted on the upper end of a control shaft 10 designed to be moved in translation during the abovementioned pipetting steps, according to a longitudinal central axis 12 of the pipette 1. The control button 8 is coupled in rotation to the control shaft 10, in the same way as this latter exhibits a lower end that fits into a volume adjusting screw 14 (see e.g., FIG. 3). The fit is designed such that one rotation of the control shaft 10 causes a rotation of the screw 14 along its own axis, preferably combined with the longitudinal central axis 12 of the pipette.

In a known manner, the rotation of the adjustment screw 14 causes translation along axis 12, or the translation of another piece, in order to axially displace a piston lodged in a suction chamber in the lower part 4 of the pipette. It is the adjustment of the upper position of the piston that makes it possible to affect the volume ultimately sampled in the pipetting process.

Figure 4:
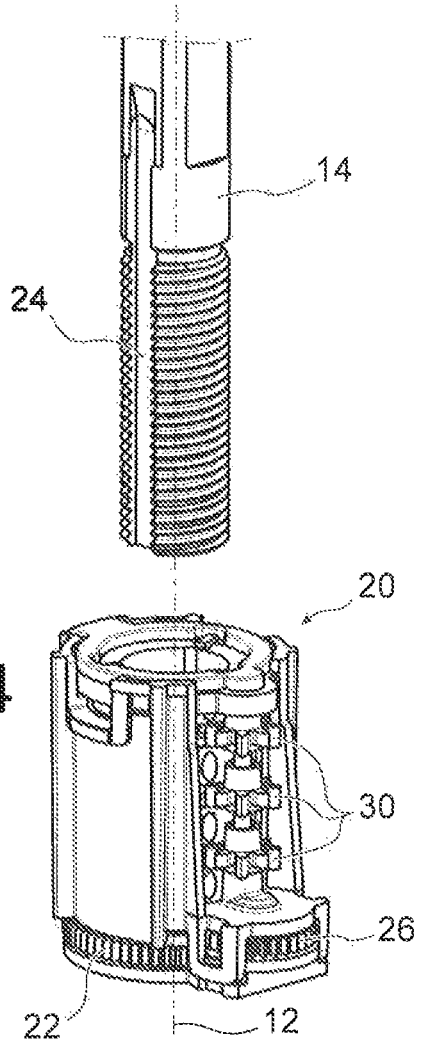
FIG. 4 shows an isometric view of a counter used on the pipette of FIGS. 1-3.

FIGS. 2 and 4 depict that the volume adjustment screw 14 causes, in rotation, a counter 20, designed to display the adjusted volume value through a window 7 (see FIG. 1) of the handle 2. The counter 20 depicted in FIGS. 2 and 4 is a four-digit counter, which utilizes four figures. This type of counter offers greater precision as compared to counters consisting of fewer figures, (e.g., a counter with only three figures). However, three figure counters 100 (shown in FIGS. 13A and 17A) also provide many benefits including economy of production by manufacturers and economy of purchase for users. Additionally, there may be scenarios where it would be desirable to include an electronic counter. For example, with high volume pipettes, such as a 10,000 μL nominal volume pipette, an electronic counter can help provide a five digit display to the user. Therefore, it may be desirable to use three-digit counters in some applications, four-digit counters in other applications, and electronic counters in further applications, as described in more detail below.

Figure 5:
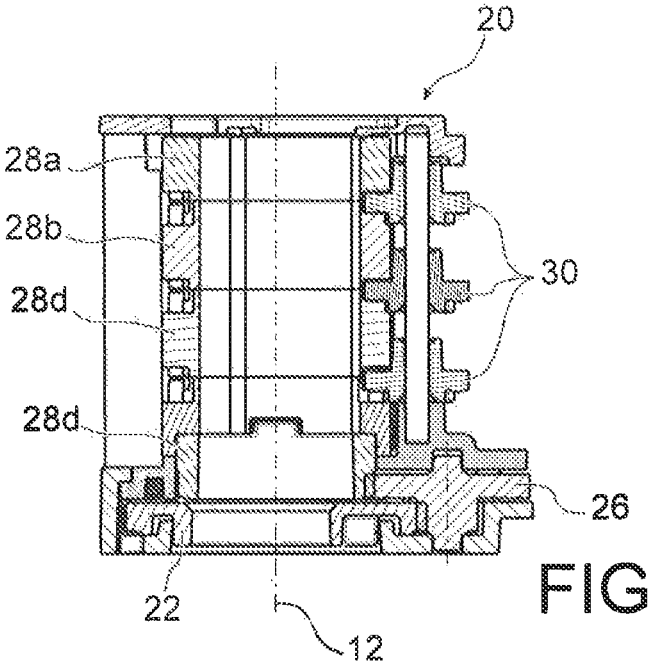
FIG. 5 shows a longitudinal cross-sectional view of the counter of FIG. 4.

The counter 20 comprises a system of gears equipped with an exterior toothed wheel 22 centered on the axis 12, directly driven in rotation by the adjustment screw 14. The driving occurs, for example, through a lug projecting inwards starting from a wheel 22, and lodged in a longitudinal groove 24 of the screw 14. The wheel 22 gears with another eccentric wheel 26 with exterior teeth, which itself gears with a set of teeth provided on a fourth drum 28*d* of the counter 20, which gives information to the fourth adjusted volume figure. The fourth drum 28*d* (See FIG. 5) rotates at a higher speed relative to the control button, for example, at a speed that is five times higher.

The counter 20 also comprises a first drum 28*a*, a second drum 28*b*, as well as a third drum 28*c* which respectively display the first, second, and third figures of adjusted volume. The drums 28*a*-28*d* are stacked along the axis 12, and drive each other in a known manner, through movement transmission devices 30. In applications where a three-digit counter is desired, the fourth drum 28*d* may be omitted and the three-digit counter 100 may include a transparent housing 198 (See FIG. 13C).

Figure 6:
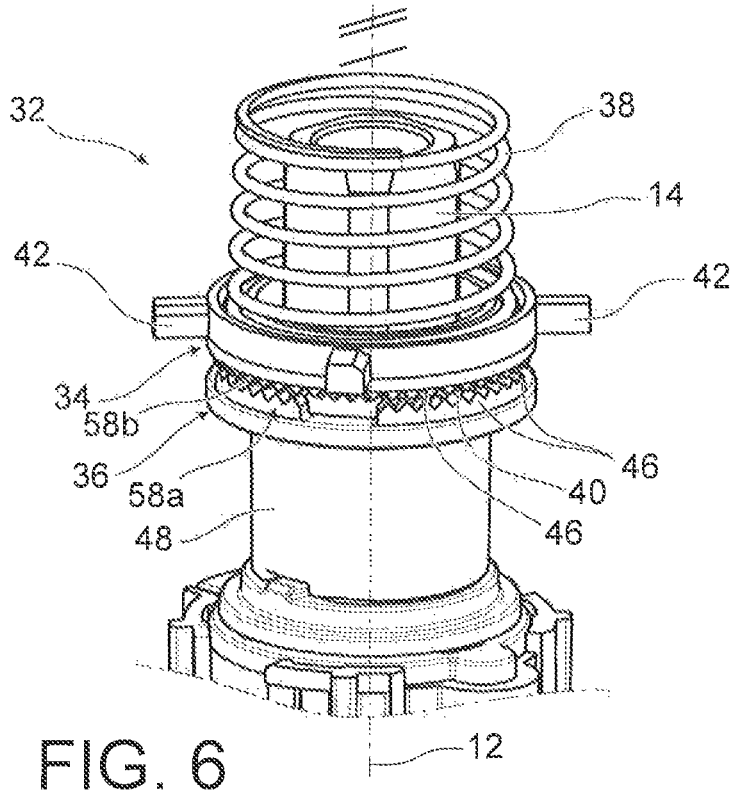
FIG. 6 shows a partial isometric view of a volume mode setting system supplied on a latching device of FIG. 2.

Referring to FIG. 6, the precision of this type of counter 20 is associated with the implementation of a volume mode setting system 32 that is specific to the disclosure, making it possible to hold/block the adjustment screw 14, once the latter has been moved to a position leading to a desired volume value. The volume mode setting system 32 makes it possible to easily move the screw 14 between different positions, when it is being rotated to change the sampling volume setting. The volume mode setting system 32 is proven to be particularly advantageous in that it makes it possible to assist the operator in precisely adjusting the last volume figure on the desired value, despite the enhanced speed of rotation of the fourth drum 28*d* observed while the pipette control button is being rotated. The ergonomics of volume adjustment are thus found to be greatly improved.

The volume mode setting system 32 depicted in FIGS. 2, 3, and 6 consists of a first toothed wheel 34 that is designed to interact with and fit with a second toothed wheel 36, and a compression spring 38 that brings the two coaxial wheels 34, 36 centered on axis 12, back against each other. In some embodiments, the volume mode setting system 32 may comprise additional components not specifically discussed herein, or may alternatively include fewer components than recited. For example, in some embodiments, the volume mode setting system 32 may comprise only a single pawl (not shown) as an adjustment mechanism. However, in alternative embodiments, the volume mode setting system 32 may include alternative volume adjustment components not specifically disclosed herein. In some embodiments, the adjustment mechanism may include one or more of the volume adjustment mechanisms disclosed in PCT Publication WO 2019/202246, which is hereby incorporated by reference in its entirety.

Figure 7:
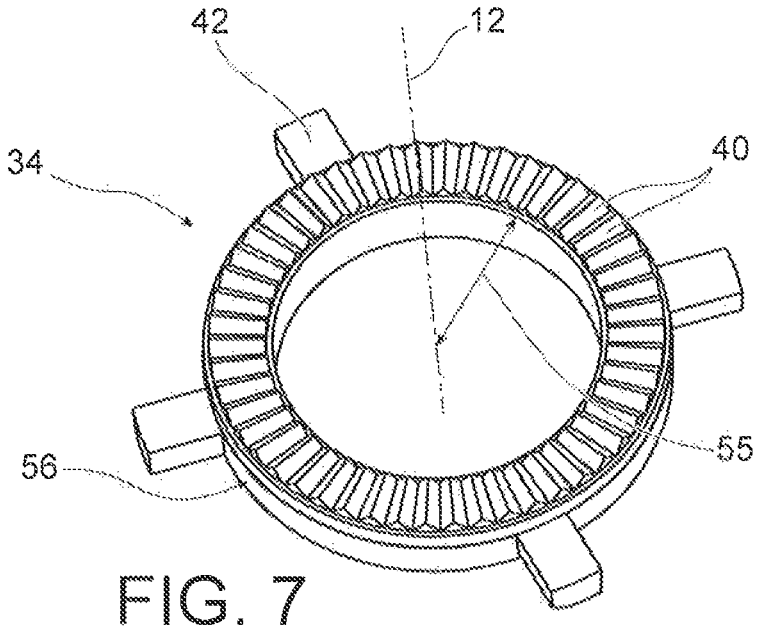
FIG. 7 shows an isometric view of a first toothed wheel supplied on the engagement holding system of FIG. 6.

Referring to FIGS. 6 and 7, the first wheel 34 is the wheel that is located highest on the pipette, and comprises primary teeth 40 that extend axially downward. The wheel 34 is fixed in rotation relative to the handle 2 by radial lugs 42 spaced circumferentially and that project outward from the wheel 34. Each lug 42 is lodged sliding in the longitudinal groove 44 of the interior surface of the handle 2, as is shown schematically for one of them in FIG. 3. The first wheel 34 thus remains fixed in rotation in the handle 2, but mobile in translation inside of the latter, according to the axis 12.

Referring back to FIG. 3, under the first wheel 34, which is likewise referred to as the blocking wheel, the second wheel 36 comprises secondary teeth 46 that extend axially upward. The second wheel 36 is mounted on a ring 48, or a barrel, the low end of which comprises a means of coupling in rotation 50 which is crossed by the adjustment screw 14. The means 50 ensures coupling in rotation with screw 14 by complementarity shape, for example by the presence of a plane or similar component. The wheel 36 thus remains steered in rotation by the adjustment screw 14, and remains fixed in translation. This configuration is obtained by causing the ring 48 to rest on a low stop 54 that is brought inside of the handle 2, and/or by causing the wheel 36 to rest on an interior shoulder 57 of the handle 2.

The spring 38 applies a pressure on the upper part of the first wheel 34, via a low spring end lodged in an upper recess of the wheel 34. The axial force developed by the spring 38 thus causes the first wheel 34 to shift downwards and to press itself against the second wheel 36 which remains fixed in translation, with, consequently, the first and second teeth 40, 46 being fitted together.

Figure 8:
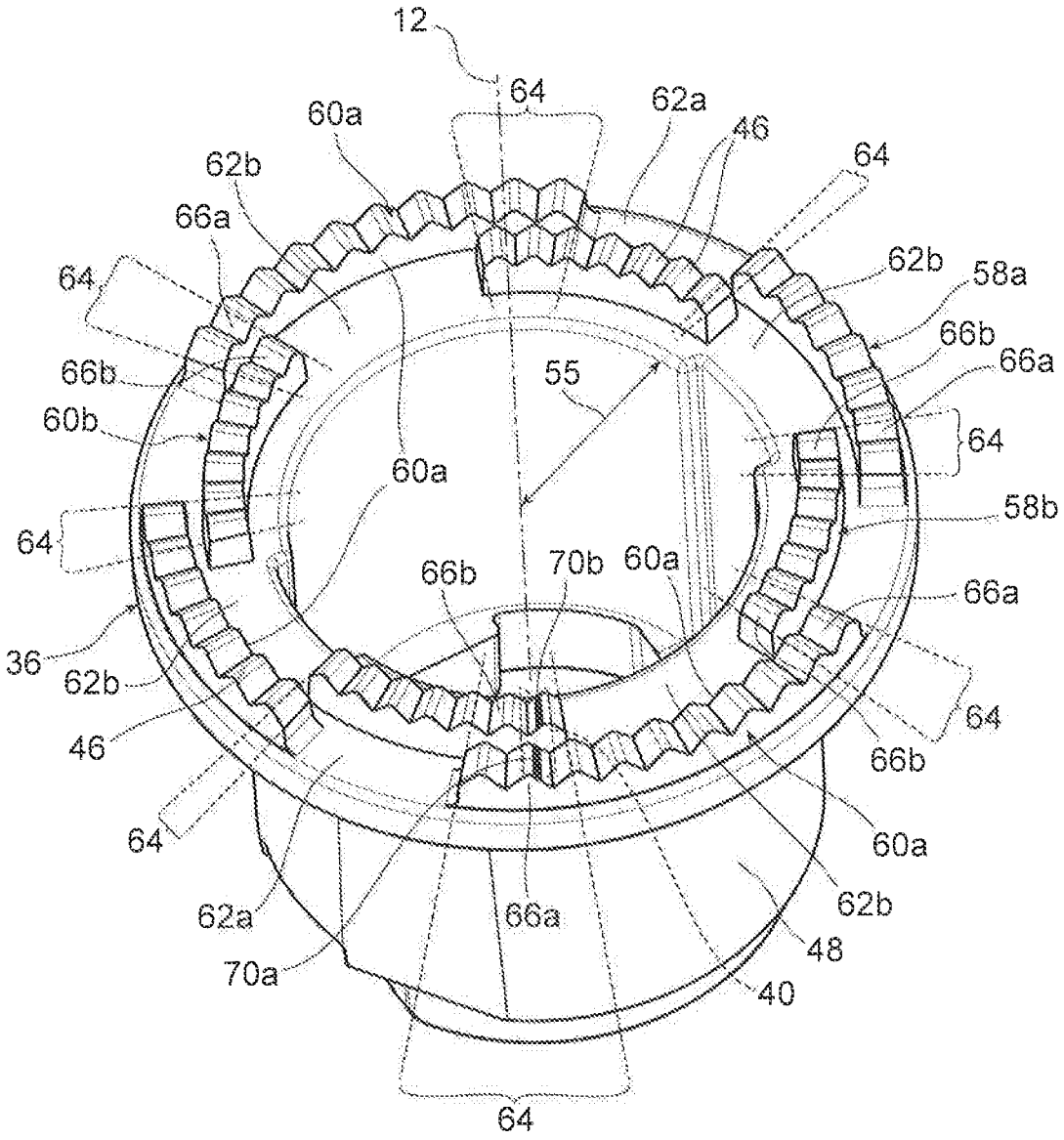
FIG. 8 shows an isometric view of a second toothed wheel used on the engagement holding system of FIG. 6.
Figure 9:
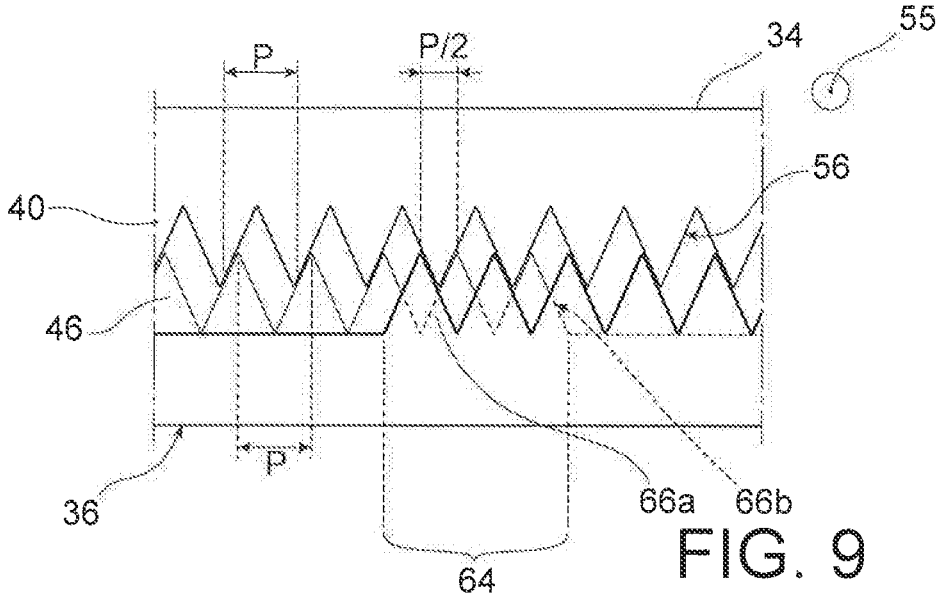
FIG. 9 is a schematic side elevational view showing the fit between the first and second toothed wheels of FIGS. 7 and 8, respectively.

A preferred arrangement of the teeth is described with respect to FIGS. 7-9. First of all, with respect to the first wheel 34, the first axial teeth 40 are arranged within a single annular row 56, which is centered on the axis 12 and preferably continuous over 360°. The number of teeth 40 may for example be on the order of fifty, with a regular pitch P provided between the teeth 40. The second wheel 36 comprises two annular rows, or a higher number of rows, e.g., three rows, or four rows, or five rows. Nevertheless, in the preferred manner of embodiment described, this number is set at two concentric annular rows 58*a*, 58*b*, centered on the axis 12.

Referring to FIG. 8, the first row 58*a*, corresponding to the exterior row, is discontinuous. This implies that it is formed by toothed portions 60*a* each of which corresponds to a circular arc provided with the teeth 46. The toothed portions 60*a* are spaced circumferentially from each other, preferably in a regular manner. Between the toothed portions 60*a*, non-toothed portions 62*a* are provided, and which correspond to hollowed-out portions. As an example, the first annular row 58*a* comprises four toothed portions 60*a* of about ten teeth each, as well as four non-toothed portions 62*a* which noticeably exhibit the same angular span as the toothed portions 60*a*.

In a similar manner, the second row 58*b*, corresponding to the interior row, is discontinuous. This implies that it is formed by toothed portions 60*b* each of which corresponds to an arc segment provided with the teeth 46. The toothed portions 60*b* are spaced circumferentially from each other, preferably in a regular manner. Between the toothed portions 60*b*, there are non-toothed portions 62*b*, corresponding to hollowed-out portions. As an example, the second annular row 58*b* consists of four toothed portions 60*b* of about ten teeth each, as well as four non-toothed portions 62*b* that present substantially the same angular span as the toothed portions 60*b*.

As illustrated in FIG. 8, the toothed portions 60*a*, 60*b* are arranged offset, such that each toothed portion 60*a* is located essentially radially facing a non-toothed portion 62*b* of the second row 58*b*, just as each toothed portion 60*b* is located essentially radially facing a non-toothed portion 62*a* of the first row 58*a*. The pitch between teeth 46 of each toothed portion 60*a*, 60 is the same pitch P as for the teeth 40 of the first wheel 34. At the ends of these toothed portions 60*a*, 60*b* that are recovered partially according to radial direction 55, tooth recovery zones are formed, with these zones being referenced 64 on FIG. 8.

Each recovery zone 64 is formed by a recovery sector 66*a* corresponding to one end of one of the toothed portions 60*a*, as well as by a recovery sector 66*b* corresponding to one end of one of the toothed portions 60*b*. The two sectors 66*a*, 66*b* are thus facing each other radially, to form one of the recovery zones 64 (e.g., eight zones), spaced regularly from each other. The number of teeth per sector 66*a*, 66*b* is for example between 2 and 5, and may be 2, 3, 4, or 5.

Within each recovery zone 64, the teeth 46 of the sector 66*a* are offset by a half-pitch P/2 relative to the teeth 46 of the sector 66*b*. Referring to FIGS. 8 and 9, each first tooth 40 that is located in cooperation with one of the recovery zones 64 of the second wheel 36 is in contact on one side with one of the teeth 46 of the sector 66*a* of this zone, and in contact on the other side with one of the teeth 46 of sector 66*b* of this same recovery zone 64. FIG. 9 schematically depicts a first tooth 40 in contact with two teeth 46 directly consecutive along the circumferential direction, and belonging respectively to two sectors 66*a*, 66*b*.

To do this, the radial length of each first tooth 40 is, for example, about twice as large as the radial length of each second tooth 46, which makes it possible to establish two contact surfaces 70*a*, 70*b* between a first tooth 40, and the two teeth 46 that are directly consecutive inside the recovery zone 64. In this regard, it should be noted that these surfaces 70*a*, 70*b*, which are visible at the bottom of FIG. 8, are arranged on the upper part of teeth 46. This can be explained by the offset of the phases applied between the teeth 46 of the two sectors 66*a*, 66*b*, which result in the first teeth 40 not fully penetrating into the hollows formed between the second teeth 46.

In operation, when the operator adjusts the desired volume using the control button 8, s/he drives the screw 14, which itself causes the simultaneous rotation of the second wheel 36. Adjusting the volume between its lower and upper boundaries habitually requires multiple turns of the control button. During the rotational motion of the second wheel 36, the second teeth 46 in motion exert a force on the first teeth 40, which tends to push the first wheel 34 axially upward, before the wheel 34 is once again forced to go back downward under the antagonistic effect of spring 38. This back-and-forth axial motion of the first wheel 34 is observed each time one tooth passes to another, and it makes it possible for the volume mode setting system 32 to index the screw 14 in a very high number of positions. This facilitates the execution of a precise adjustment of the desired volume. In particular, within each recovery zone 64, the number of possible positions for the same first tooth 40 relative to wheel 46, corresponds noticeably to double the number of second teeth 46 in each recovery sector 66*a*, 66*b* that forms each zone 64.

As an example, it can be noted that during one 360° rotation of the adjustment screw 14, it can be indexed in dozens of different angular positions, with each of these positions being stable and precise, due to the fit, at each different time, between the first and second teeth 40, 46. The precision of the volume adjustment is advantageously accrued, without altering the ease of manufacture of the toothed wheels 34, 36. The wheels 34, 36 can be produced by plastic injection, while preserving a satisfactory tooth quality.

FIGS. 3, and 10-12 depict a control system 74 with the volume mode setting system 32 detailed above. When combined, the systems 32, 74 form a latching device 80 of the adjustment screw 14, where the device 80 offers numerous functionalities.

With respect to FIG. 3, the control system 74 comprises two distinct parts, both of which are annular and stacked along the axis 12 on which they are centered. A position selector 82 is displaced in rotation according to the axis 12 between three positions, which include a position of free adjustment, a fine adjustment position, and a latching position. The selector 82 comprises an exterior grip portion 84 that projects axially upward relative to the handle 2, and is arranged about the control shaft 10. The exterior grip portion 84 appears in the form of a collar that can be easily grasped by an operator, between the thumb and index finger.

The exterior grip portion 84 is followed by an interior part 86 of the selector, made of a single block with the exterior grip portion 84. The interior part 86, which is lodged inside of the handle 2, surrounds a part of the spring 38. At its lower end, the interior part 86 fits into the other part of system 74, namely an annular control device 88 that surrounds the two toothed wheels 34, 36. The two parts 82, 88 are coupled to each other in rotation, through components 90 on an upper end of the control device 88, lodged in axial slots 92 on the low end of the selector 82. The two parts 82, 88 are designed to remain fixed in translation along the axis 12, while still being able to turn together about this same axis 12.

The control device 88 fits with the first toothed wheel 34, constituting the blockage wheel of the volume mode setting system 32. This fit occurs via the radial lugs 42, which radially cross the control device 88 so that their outer ends become lodged in a sliding manner in the longitudinal grooves 44 of the handle 2.

Figure 10:
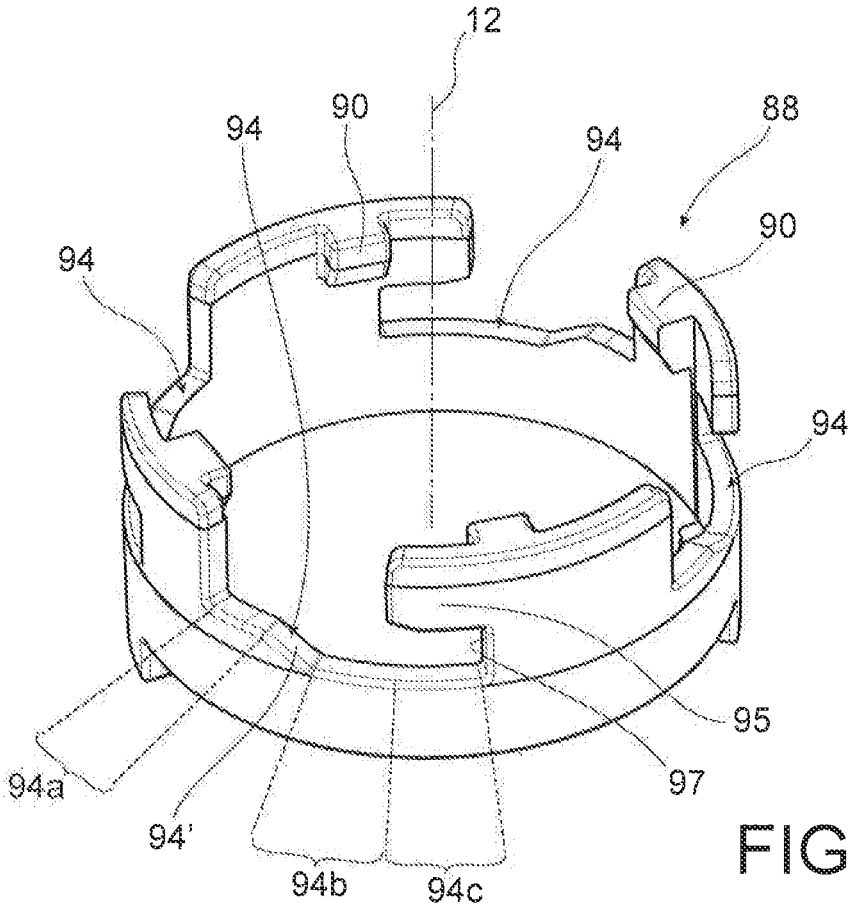
FIG. 10 shows an isometric view of a control device of a control system for the latching device of FIG. 3.

Each radial lug 42 is associated with a track of the control device 88, by being pressed up against this track via the spring 38 which acts on the toothed wheel 34 that bears these lugs. Four radial lugs 42 and four tracks are provided on the control device 88, as shown in FIG. 10. In fact, each of the four tracks 94 extends on an angular sector of the control device 88, which is slightly less than 90°. The four tracks 94 thus present substantially identical shapes, and are provided so that they fit with their associated lugs, in a simultaneous manner. For this reason, the shape of only one of these tracks 94 is described below.

Referring to FIG. 10, the track 94 includes a first portion of track 94*a*, corresponding to a highest portion of the track in the axial direction. As depicted on the right of FIG. 10, a second portion of track 94*b* is provided, which is offset axially from the first portion of the track 94*a*, by being located lower. A transition zone 94' is arranged between the two portions 94*a*, 94*b*, with the transition zone 94' taking the shape of a slope that inclines downwards, going from the first track portion 94*a* to the second track portion 94*b*.

Finally, a third portion of track 94*c* is provided to the right starting from the second portion of track 94*b*, the third portion 94*c* being located axially at the same level and in the continuity of the second portion 94*b*. A stop component 95 is arranged facing axially from the third track portion 94*c*, being borne by the control component 88. With this third track portion 94*c*, the stop component 95 forms a slot 96 that is circumferentially open from the side where the second portion 94*b* is located. On the opposite side, the slot 96 is closed by a slot bottom 97. Consequently, this configuration takes the shape of a hook that is circumferentially open in the direction of the second track portion 94*b*.

Figure 11A:
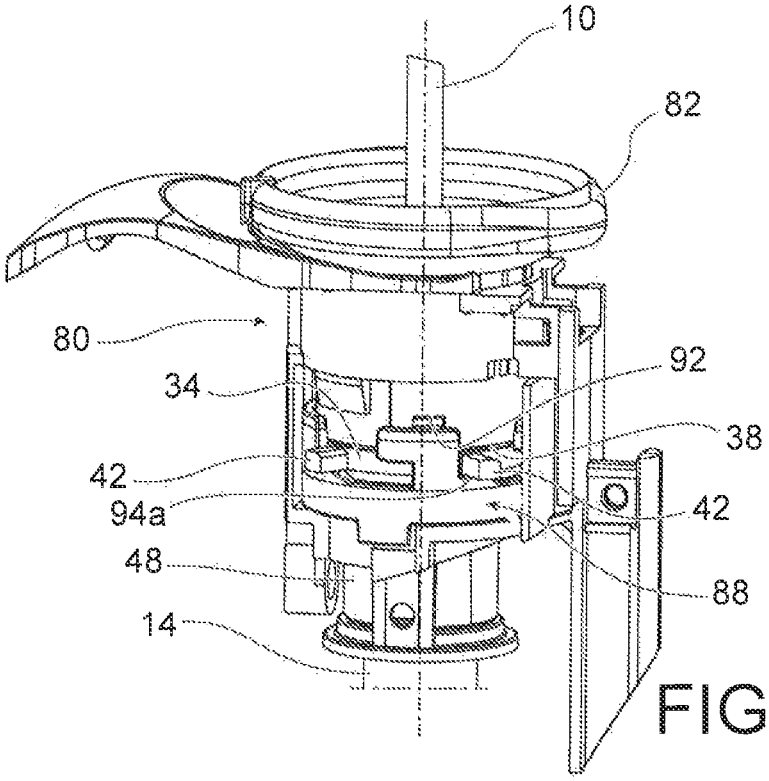
FIGS. 11A to 11C are isometric views of the control system in different positions.
Figure 11B:
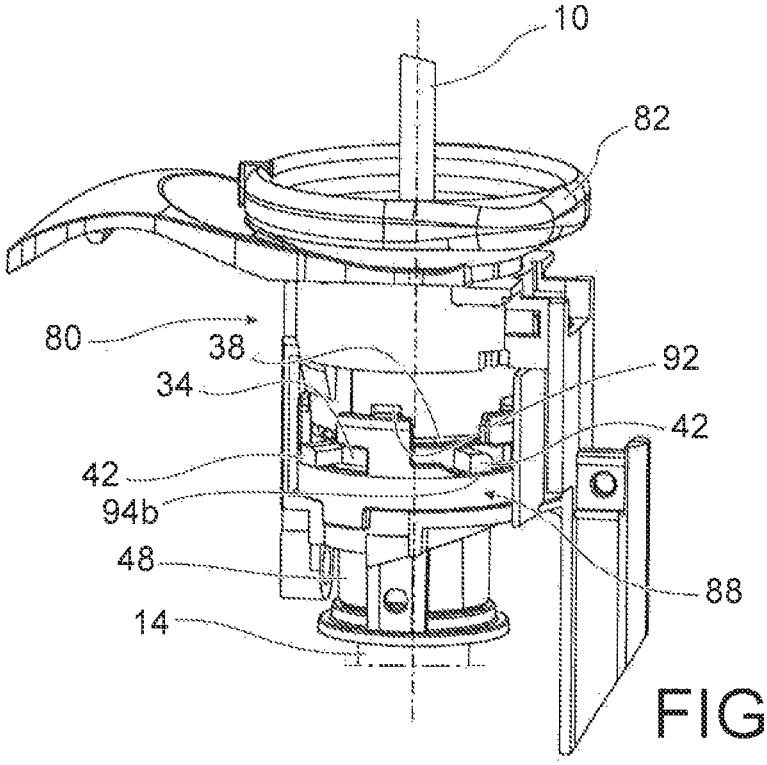
Figure 11C:
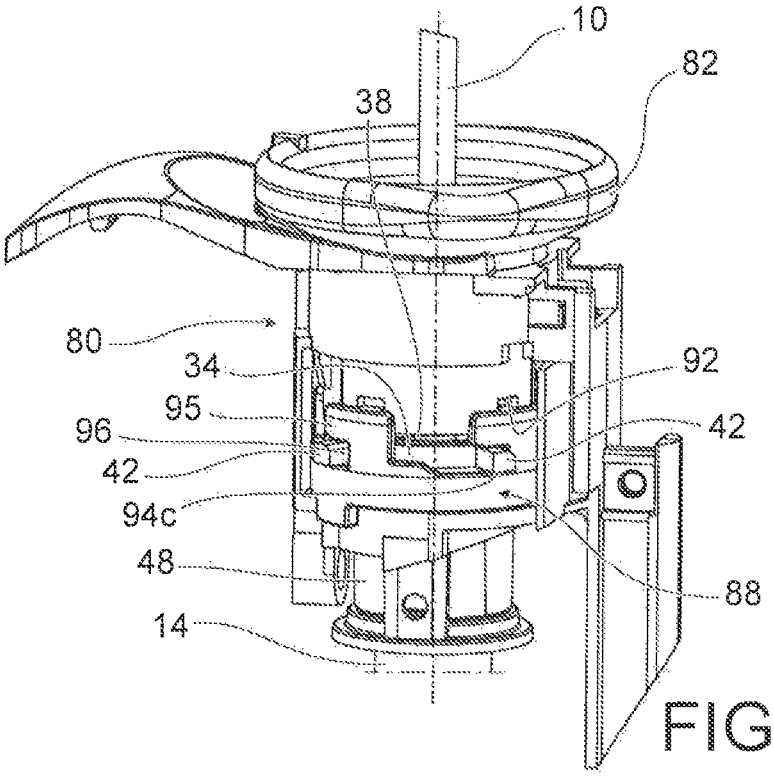

FIGS. 11A to 11C depict the latching device 80 shown in different positions. More specifically, FIG. 11A shows the selector 82 in a position of free adjustment, bringing the radial lugs 42 onto the first portions of the track 94*a*. This way, the first portion 94*a* holds the blockage wheel 34 upwards, in a position that is axially separated from the second toothed wheel 36. This axial separation occurs by opposing the force developed by spring 38 on this same toothed wheel 34, such that the first and second teeth do not fit into each other as was described in reference to FIG. 9. In this position, because the teeth no longer oppose the resistance to rotation of the volume adjustment screw 14, a wide range of volume may be selected, without specific efforts on the part of the operator. The ergonomics of volume adjustment are thus found to be advantageously improved.

Subsequently, with respect to FIG. 11B, the selector 82 is shown in a position of fine adjustment, leading the radial lugs 42 onto the second track portions 94*b*. The spring 38, which presses the lugs 42 against the second portion of track 94*b* located axially lower, places the wheel 34 so that it fits with the second toothed wheel 36. The first and second teeth of these wheels fit into each other, and the passing of one tooth to another occurs further to the rotation of screw 14, as part of a precise and ergonomic adjustment. It is in this position of adjustment that the main passage of one tooth to another occurs, as shown in reference to FIGS. 7 to 9. In fact, the control device 88 enables the wheel 34 to move away from, and then to move axially towards, the second wheel when one tooth passes to another due to the rotation of this second wheel, given that the lugs 42 are free to shift axially upward with the wheel 34.

Finally, referring to FIG. 11C, the selector 82 is shown in a latched position, leading the radial lugs 42 onto the third track portions 94*c*. More precisely, each lug 42 is lodged axially between the third track portion 94*c* on which it is forced into support by the spring 38, and the axial stop component 95, in order for it to be trapped axially in the slot 96. The stop components 95 therefore block all axial upward displacement of the lugs 42 and of the associated wheel 34, thus preventing all disengagement of the first and second teeth. Consequently, the adjusted volume cannot be modified. The latched position depicted in FIG. 11C is preferentially adopted during the pipetting operations, in order to prevent the operator from accidentally changing the target volume by rotation of the control button, on which his/her thumb is pressed.

The three positions are thus selected in an appropriate manner by the operator, depending on the desired adjustment. For example, the start of the adjustment may be carried out in the free adjustment position in order to effortlessly select from a wide range of volumes, then as the target value is approached, the fine adjustment position may be adopted in such manner as to easily attain this precise value. Once this value has been attained, the selector may then be placed in the latched position, in order to prevent any accidental change of the target volume, during the subsequent pipetting operations.

Figure 12:
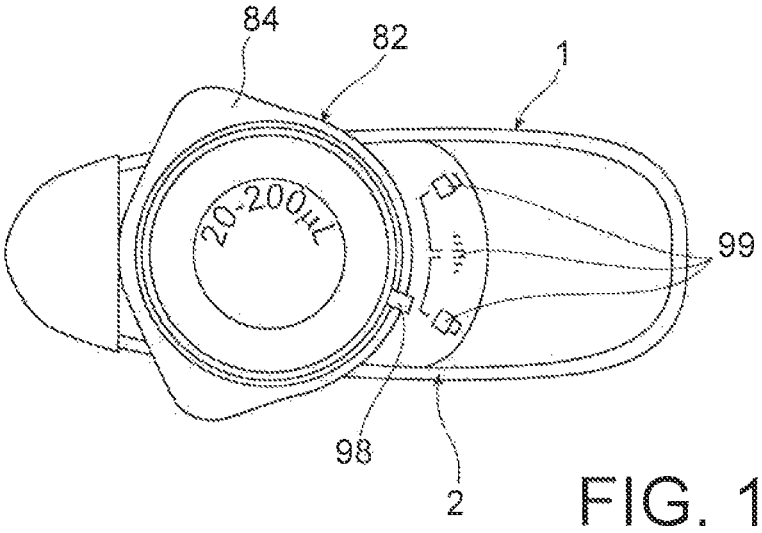
FIG. 12 shows a top plan view of the pipette of the preceding figures.

FIG. 12 depicts a system that makes it possible to visually inform the operator about the position of selector 82 associated with the pipette 1. To do this, the exterior surface of the handle 2 or the exterior portion of the grip 84 of the selector 82 features a cursor 98, whereas the other of these two components features three references 99 that respectively schematize the three possible positions. The alignment of the cursor 98 with one of the references 99 is what makes it possible for the operator to determine the position in which the selector 82 is located. In this regard, it should be noted that the position of free adjustment of the selector 82 is found to be offset by an angular value of between 15 and 30° relative to the fine adjustment position located in the center. Likewise, in the opposite circumferential direction, the latching position is found to be offset by an angular value of between 15 and 30° relative to the fine adjustment position. These angular values are, e.g., on the order of 20°, corresponding to the angular displacement to which the operator must subject selector 82, in order to pass the central position of fine adjustment to one of the two end positions of free adjustment or of latching.

Finally, in addition to references 99, the operator is alerted about the passage of selector 82 to each of the three positions by audible clicks, which are obtained in the standard manner by shapes that fit between handle 2 and selector 82.

Of course, various modifications can be made to the disclosure. For example, within the volume mode setting system 32, modifications could be made to place the multiple annular rows on the first wheel, and not on the second toothed wheel 36, which would then present only a single annular row of teeth. Alternatively, the two toothed wheels could each feature a single annular row of teeth, without departing from the scope of the disclosure. As described above, various embodiments of the pipette 1 can include a number of functional features, such as a three or a four-digit counter, an electronic counter and/or a latching device 80. As provided the above description, depending on which functional features are included in the pipette 1, different interior adjustment parts are installed within the housing.

Referring now to FIGS. 13A-17B and 20, a pipette system 102 is depicted according to an embodiment of the present disclosure. The pipette system 102 includes a pipette body 104, which has a housing 112, a control button 118, a control shaft 120, an ejector system 114, and a window guide 122. The pipette system 102 can also include features such as a sampling cone mounting tip and a sampling cone (not shown). The housing 112 defines an interior space 126, which is dimensioned to receive a plurality of interior adjustment parts 110, in addition to a counter such as a four-digit counter 20, a three-digit counter 100, or an electronic counter 226 (shown in FIG. 20), among other components. During the manufacturing process, it is contemplated that the housing 112 of the pipette system 102 is dimensioned to receive, and be used with, a single counter at a time. The housing 112 includes an opening 128 positioned on a front wall 130 that is sized allow a user to view the four-digit counter 20, the three-digit counter 100, or the electronic counter 226. In a configuration utilizing a three-digit counter 100, the three-digit counter 100 can be coupled to a spacer 124, which results in increasing the exterior dimensions of the three-digit counter 100 so that it can structurally adapt to the space designed to also receive a four-digit counter 20. In this way, the addition of the spacer 124 is utilized to enhance the interchangeability of the counters 20, 100 within the same housing 112.

Figure 13A:
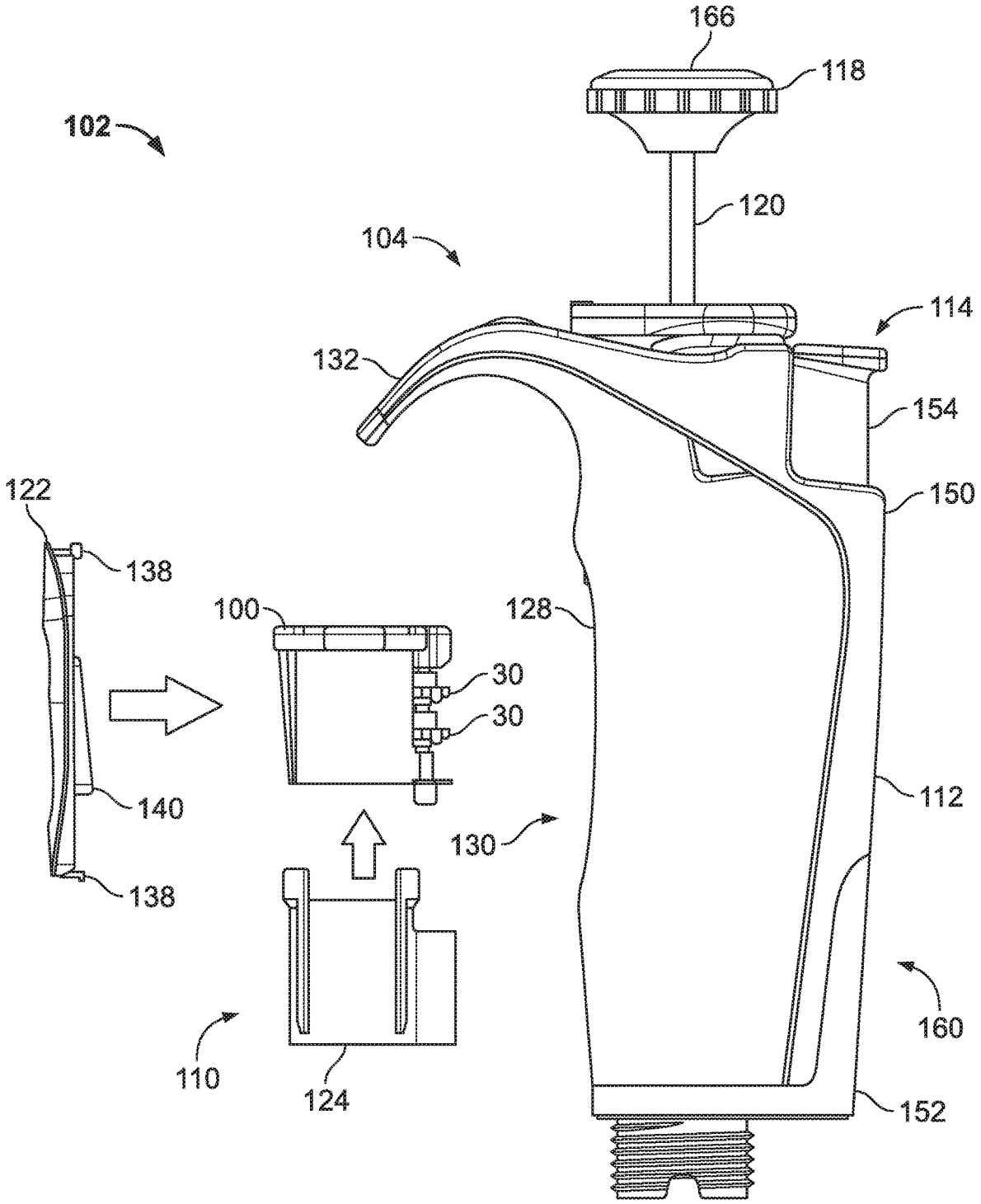
FIGS. 13A and 13B show side elevational views of portions of a pipette system with some aspects exploded from the pipette system.
Figure 13B:
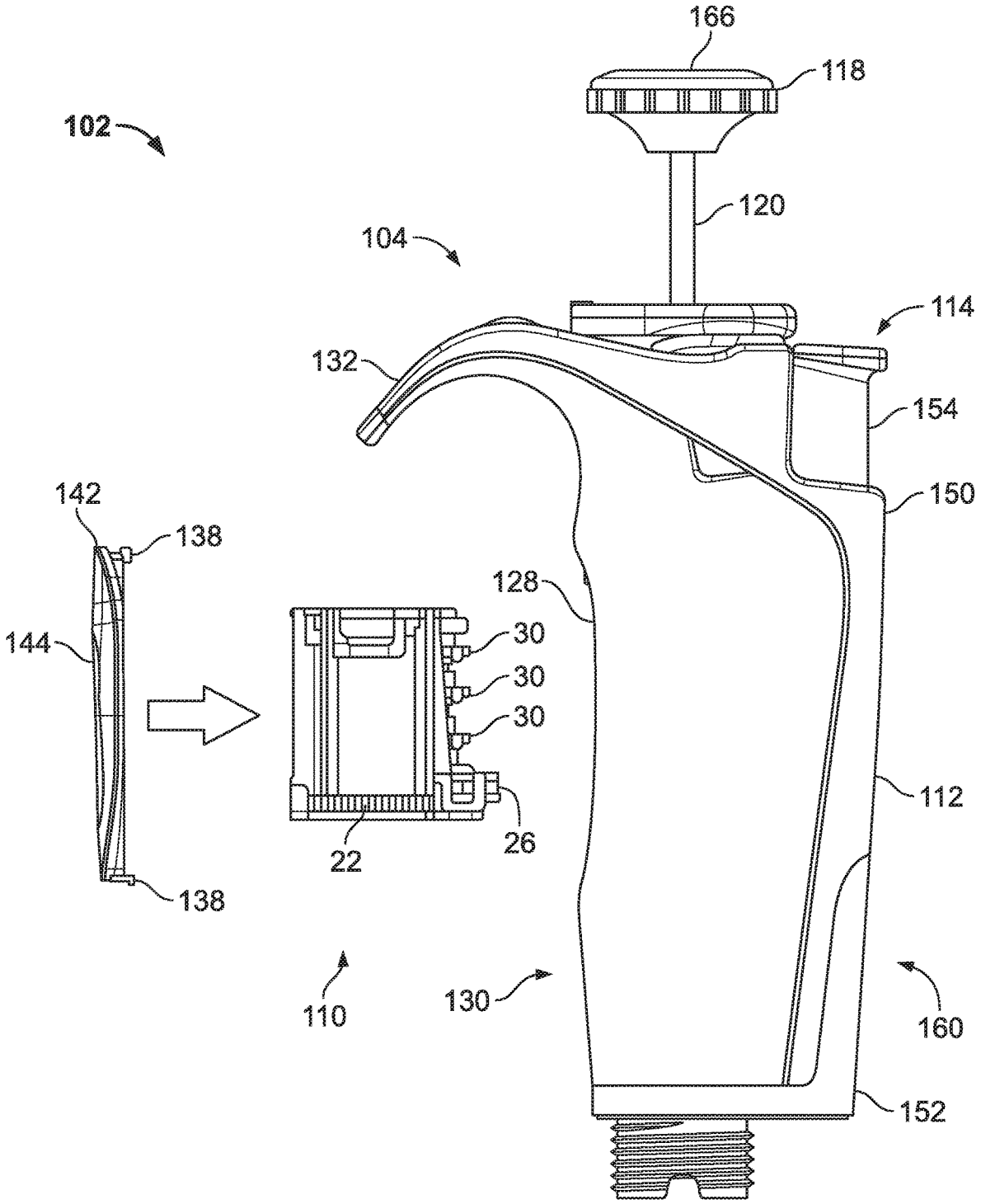
Figure 13C:
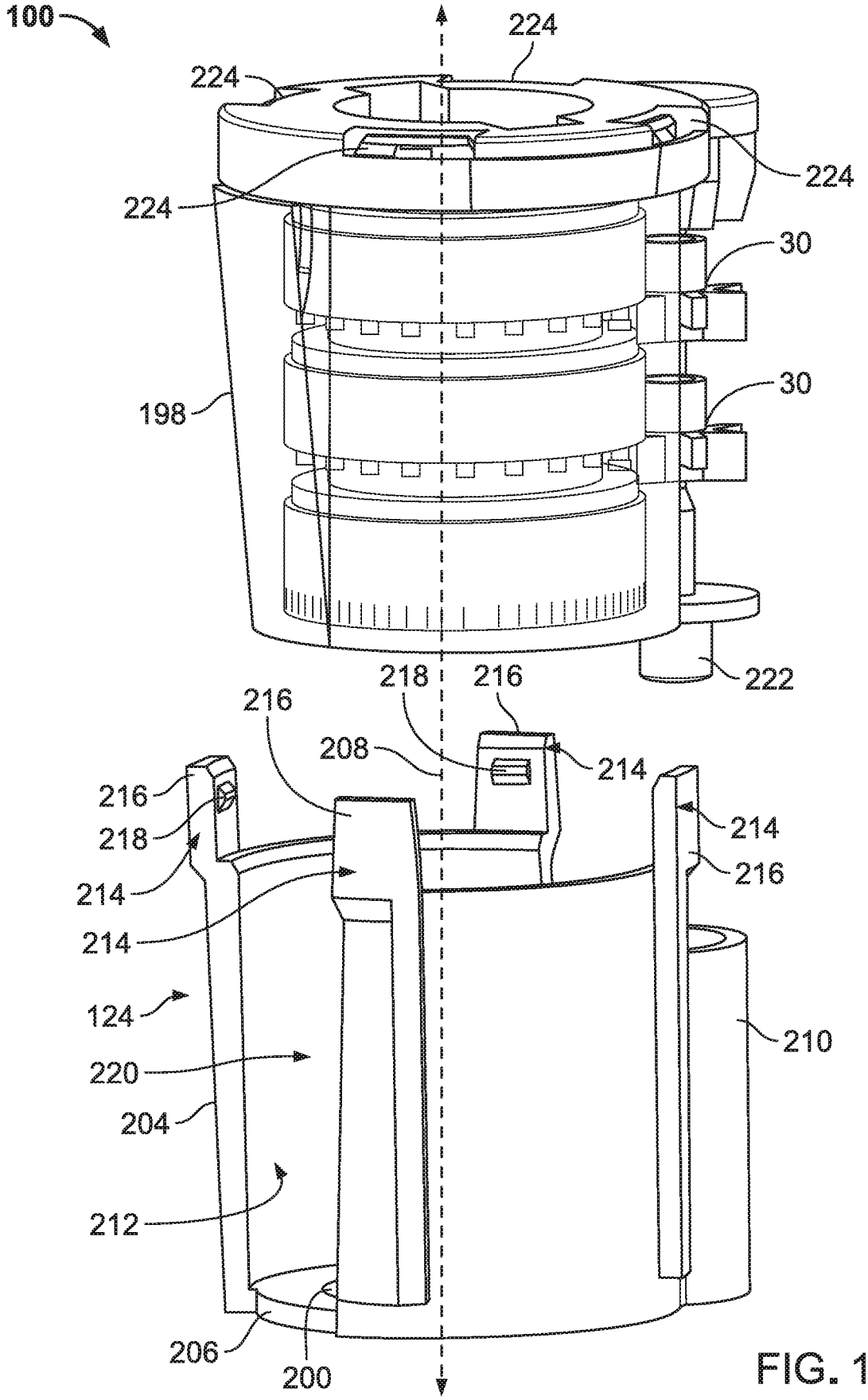
FIG. 13C shows an exploded isometric view of a three-digit counter and a spacer of the pipette system.
Figure 13D:
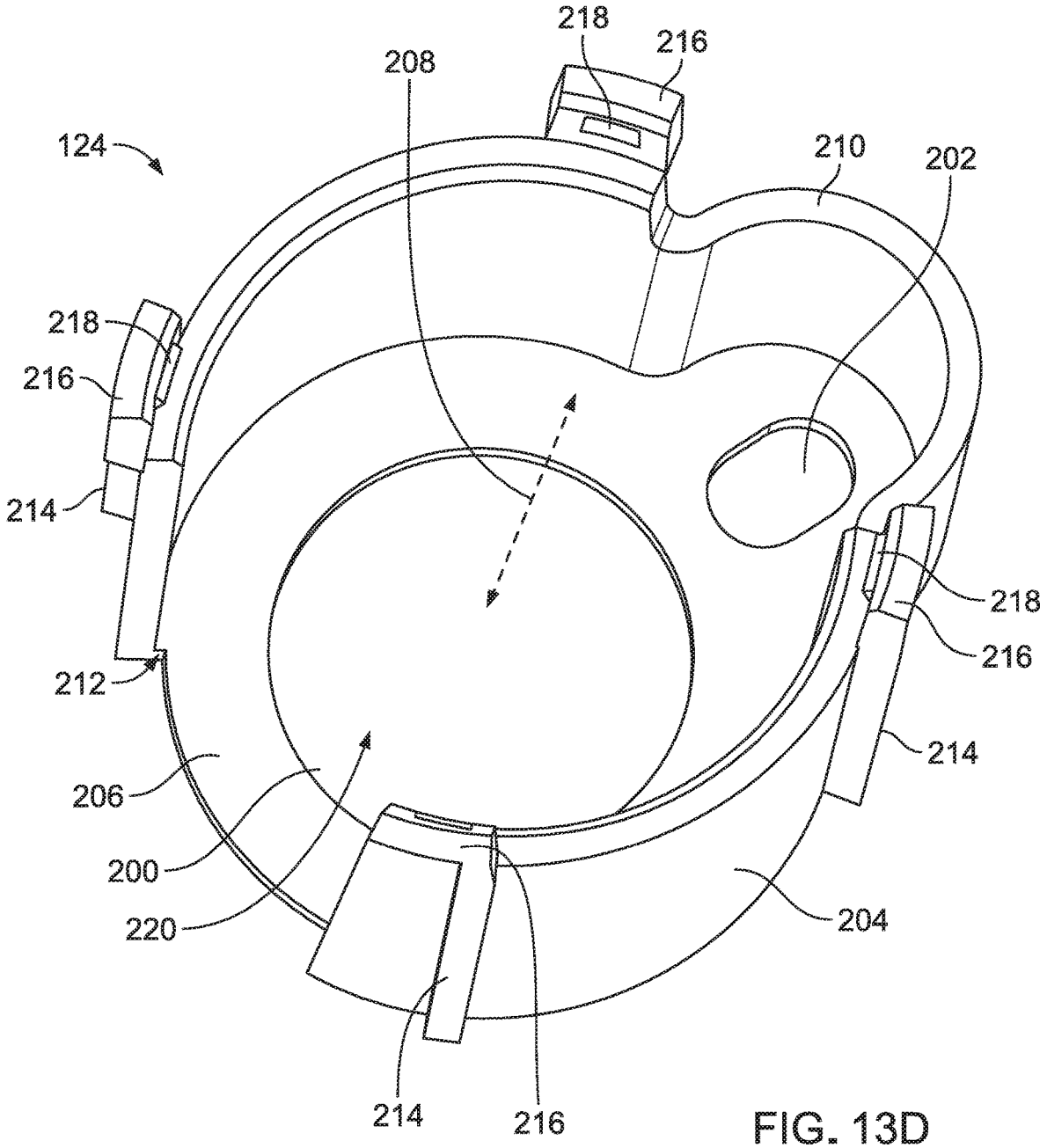
FIG. 13D shows a top isometric view of the spacer of the pipette system.

Referring to FIGS. 13C-D, the spacer 124 is provided in the form of a substantially cylindrical side wall 204 and a base 206 centered on a central spacer axis 208. The base 206 has two through-holes 200, 202. The through-hole 200 is substantially circular in shape. The side wall 204 includes a protruding half-circle 210 opposite a rectilinear opening 212. The spacer 124 includes four elongate flexible resilient arms 214 protruding outwardly from an exterior surface of the side wall 204. Each arm 214 also extends upwardly past an upper edge of the side wall 204 opposite the base 206. Each arm 214 includes a head 216 that is substantially rectangular in shape, and each head 216 includes a notch 218 that protrudes inwardly from the inner surface of the head 216 toward the central spacer axis 208. The through-hole 202 is oblong in shape and is aligned with the protruding half-circle 210.

The side wall 204 and the base 206 generally define a counter space 220 of a size and shape configured to receive and substantially surround the three-digit counter 100. The through-hole 202 is sized and shaped to receive a pin 222 extending from the bottom of the transparent housing 198 of the three-digit counter 100, and the protruding half-circle 210 is sized and shaped to receive the movement transmission devices 30. When the three-digit counter 100 is received within the counter space 220, the notches 218 extend into grooves 224 formed on the upper perimeter of the three-digit counter 100 and corresponding to the heads 216 so that the spacer 124 is mechanically coupled to the three-digit counter 100. As discussed herein, the interior space 126 of the housing 112 is designed to accommodate other sized counters. Additionally, the housing 112 forms a hook 132, which is shaped to receive the index finger of a user. The hook 132 extends away from the longitudinal central axis 12, forming an arc with a defined radius of curvature 134 (see FIG. 14).

In some embodiments, the window guide feature of the pipette system 102 is designed to correspond with a particular size and number of counting digits of the counter implemented with the pipette system 102. For example, as shown in FIGS. 13A, 13B, 17A and 17B, the window guide 122 corresponds to the three-digit counter 100, and a window guide 142 corresponds to the four-digit counter 20. The window guides 122, 142 can have an elongate ovular or egg like shape. The window guide 122 has a hollow center 136 so that the numbering of the three-digit counter 100 can be seen through the transparent housing 198 of the three-digit counter 100, and the user can determine the transfer volume of the pipette. Additionally, the four-digit counter 20 can have a window 144 that is centrally positioned on the front of the window guide 142. The window 144 is sized and positioned to correspond with the numbering of the four-digit counter 20 so that users can easily view the numbering, and, thus, determine and adjust the transfer volume of the pipette.

Referring to FIG. 13B, one or more clips 138 are provided on the back of the window guides 122, 142 and extend away from the body of the window guides 122, 142. The window guide 122 further includes a projection 140 that works in conjunction with the spacer 124 to adapt the three-digit counter 100 to matingly fit into the opening 128 and extend into the interior space 126 because interior space 126 is also sized to receive the larger, four-digit counter 20. To couple the window guide 122 to the housing 112, the clips 138 provide an interference or snap-fit into the opening 128 of the housing 112. Therefore, the window guides 122, 142 contribute to the overall modularity and customizability of the pipette system 102 by securing the corresponding counters 100, 20 which are different than each other, into the housing 112.

Figure 14:
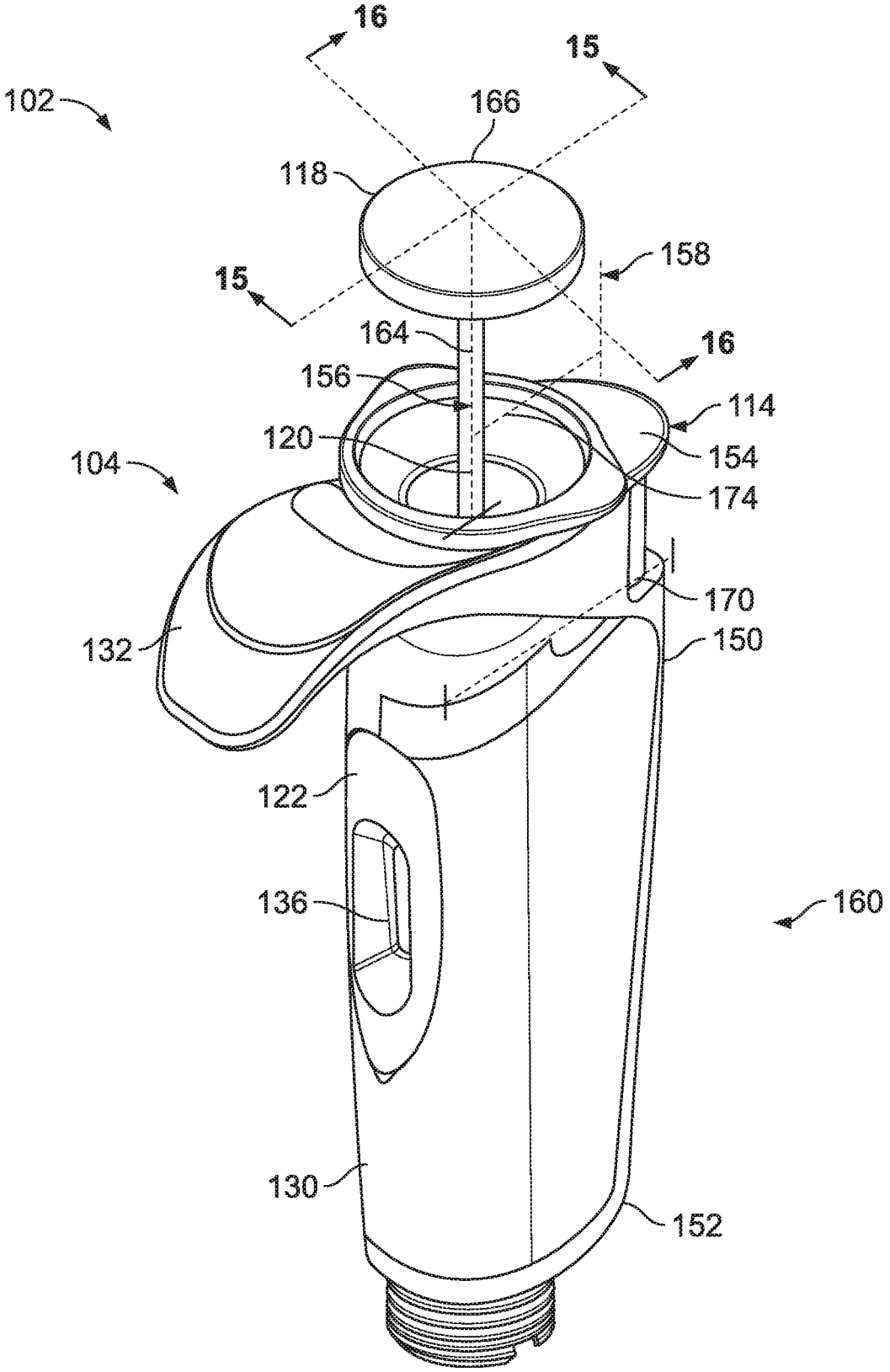
FIG. 14 shows a top isometric view of the pipette system of FIG. 13A.
Figure 15:
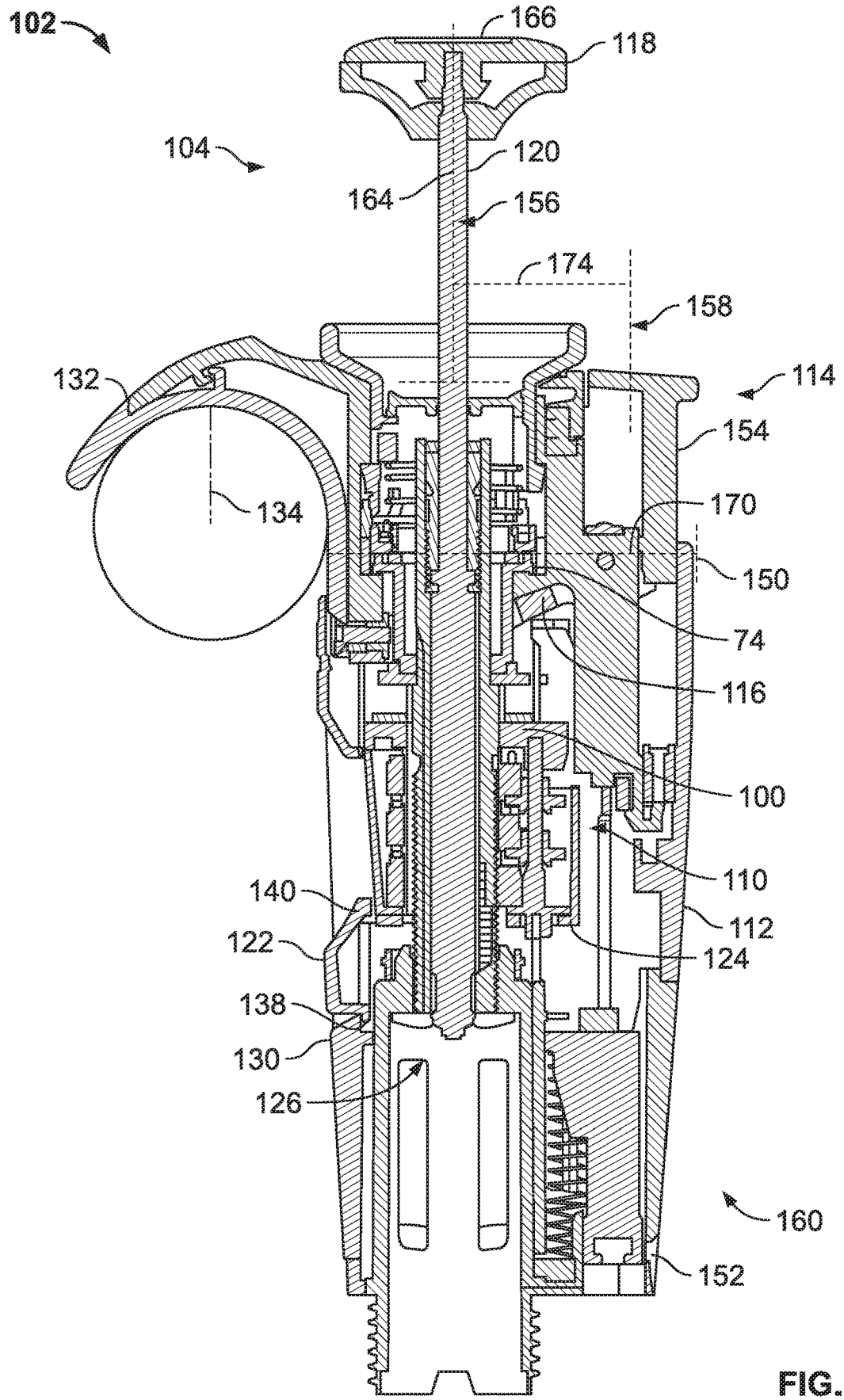
FIG. 15 shows a cross-sectional view of the pipette system of FIG. 14 taken along line 15-15 of FIG. 14.
Figure 16:
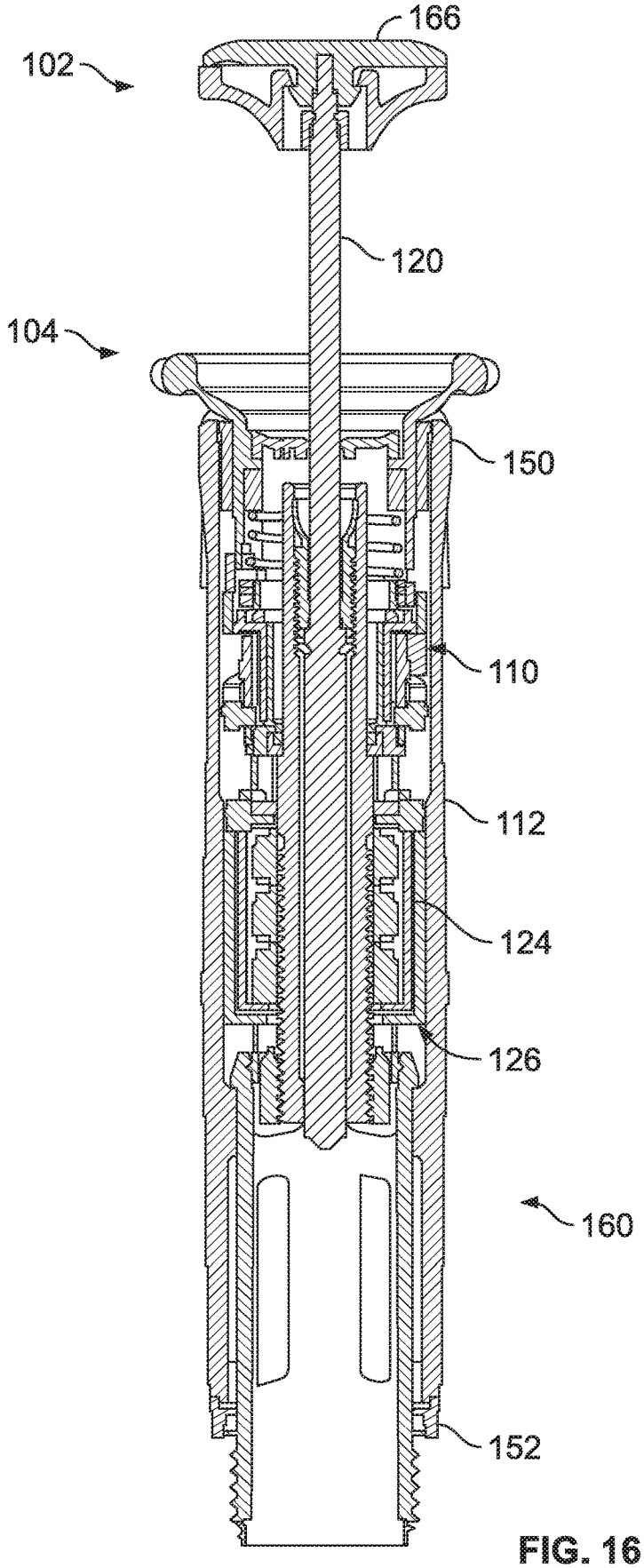
FIG. 16 shows a cross-sectional view of the pipette system of FIG. 14 taken along line 16-16 of FIG. 14.

As illustrated in FIGS. 14, the pipette body 104 further includes a control button 118 and a control shaft 120. The housing 112 has a control end 150 and a pipetting end 152. The control button 118 is coupled to the control shaft 120, which is positioned at the control end 150 of the housing 112 and extends away from the control end 150 of the housing 112 along a control central axis 156 (see FIG. 15). The ejector system 114 also includes an ejector 154 arranged along an ejector central axis 158 (see FIGS. 14 and 16).

As shown in FIGS. 13A and 13B, the pipette system 102 may include either a three-digit counter 100 (see FIG. 13A) or a four-digit counter 20 (see FIG. 13B) depending on the user's desired reading accuracy. Further, if the pipette system 102 incorporates a four-digit counter 20, the pipette body 104 will likely include one or more interior adjustment parts 110, including, for example, the eccentric wheel 26, and/or the exterior toothed wheel 22 (shown in detail in FIGS. 2, 4, and 5). In some embodiments, the combination of the three-digit counter 100 and the spacer 124 coupled together has a substantially equivalent surface area to volume ratio as the four-digit counter 20. Unless otherwise stated, the interior adjustment parts 110 include various components that allow for volume adjustment of the pipette system 102, which enables a user to adjust a volume range of the pipette system 102 based on one or more of a number of factors. While various components are disclosed herein that comprise the interior adjustment parts 110, various components are known to those of ordinary skill in the art that provide for volume adjustment of different sizes and types of volume counters. The interior adjustment parts 110 may also include one or more of the components described above with respect to the volume mode setting system 32.

In some embodiments, if the pipette system 102 includes the control system 74 (shown in FIG. 3), the pipette body 104 will likely include one or more interior adjustment parts 110 such as the annular control device 88. If the pipette system 102 includes the ejector system 114 with an added assist, the pipette body 104 will include the lever 116. The pipette system 102 can include any number of functional combinations of the above described features, such as having the control system 74 and the ejector system 114; no control system 74 and the ejection system 114; the control system 74 and the ejector system 6 (no lever 116); no control system 74 and the ejection system 6 (no lever 116); and any of the listed combinations combined with a three-digit counter, a four-digit volume counter, or an electronic counter.

To accommodate variations in the interior adjustment parts 110 corresponding to different functional features while also preserving a consistent exterior design 160 of the pipette system 102, the pipette body 104 can interchangeably receive various interior adjustment parts 110. In this way, regardless of the chosen functional features of the pipette system 102, the pipette system 102 provides the same feel, ease of use, and other ergonomic benefits for users.

Figure 17B:
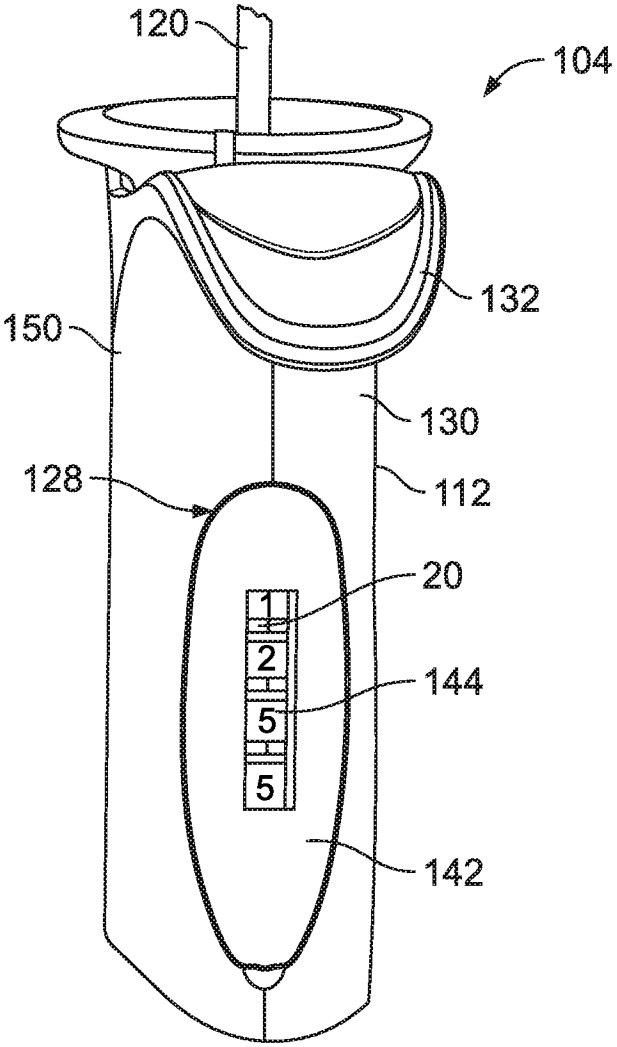
FIG. 17B shows a partial front elevational view of a pipette system utilizing a four-digit counter.
Figure 17A:
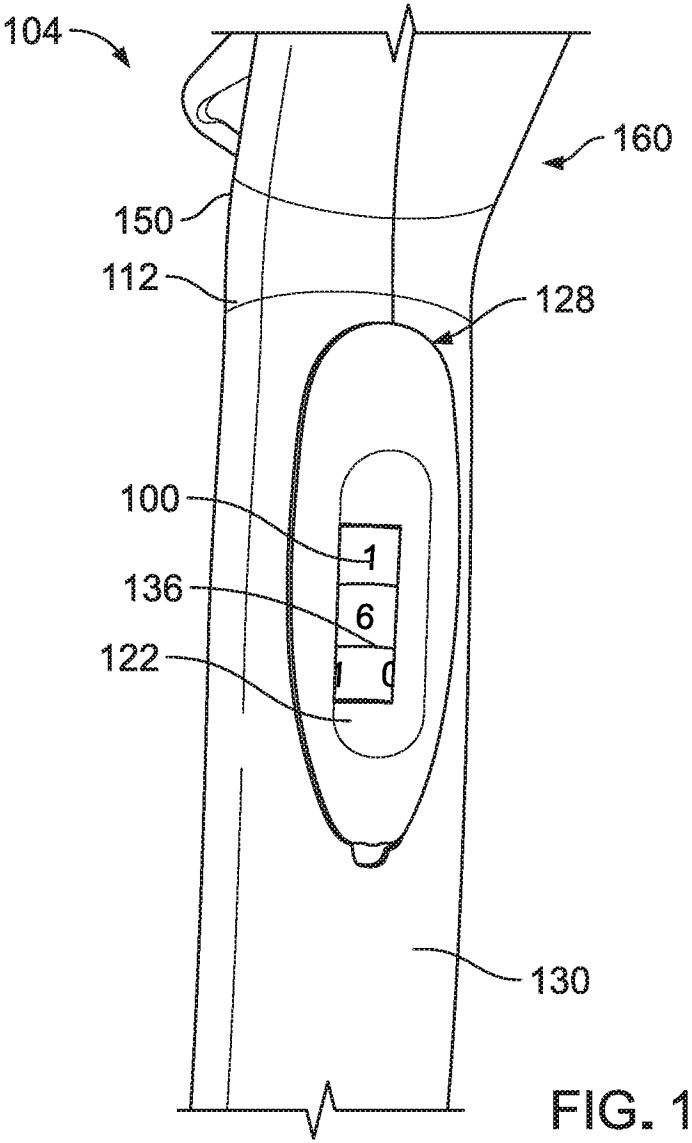
FIG. 17A shows a partial front elevational view of a pipette system utilizing a three-digit counter.

Referring to FIG. 14, the design of the pipette body 104 can be defined by its dimensions and ratios of various distances defined herein. More specifically, the hook 132 is defined by a radius of curvature 134 that is specifically dimensioned to contact a user's hand in an ergonomic configuration and to facilitate control of the pipette system during operation. The pipette body 104 is further defined by a button extension distance 164 that extends from the control end 150 of the housing 112 to the top 166 of the control button 118. It should be noted that the button extension distance 164 changes depending on the volume selected for pipetting. The widest cross-section 170 of the housing 112 is measured from the front wall 130 of the housing 112 back toward the ejector system 114, and a gripping distance 174 extends from a control central axis 156 to an ejector central axis 158. As shown in FIGS. 17A and 17B, all of these parameters are correlated to a housing 112 design that is provided in such a way as to accommodate one or more of a three-digit counter 100, a four-digit counter 20, or an electronic counter, without modification to an exterior portion of the housing 112.

The widest cross-section 170 of the housing 112 can be between about 1 and about 4 times the radius of curvature 134 of the hook 132. The widest cross-section 170 of the housing 112 can be between about 2 and about 3 times the radius of curvature 134 of the hook 132. The widest cross-section 170 of the housing 112 can be between 2.9 and 3.2 times the radius of curvature 134 of the hook 132. Additionally, the button extension distance 164 can be between about 1 and about 4 times the length of the radius of curvature 134 when the pipette is adjusted to its nominal volume (e.g. the maximum volume). The button extension distance 164 can be between 2 and 4 times the length of the radius of curvature 134, when the pipette is adjusted to its nominal volume (e.g. the maximum volume). The button extension distance 164 can be between 2.7 and 3.6 times the length of the radius of curvature 134, when the pipette is adjusted to its nominal volume (e.g. the maximum volume).

A gripping distance 174 between the central axes 156, 158 can be between about 0.1 and about 3 times the length of the radius of curvature 134. The gripping distance 174 between the central axes 156, 158 can be between 1 and 2 times the length of the radius of curvature 134. The gripping distance 174 between the central axes 156, 158 can be between 1.4 and 1.6 times the length of the radius of curvature 134. The widest cross-section 170 can be between about 1 and about 2 times the button extension distance 164. The widest cross-section 170 can be between 0.9 and 1.2 times the button extension distance 164. The widest cross-section 170 of the housing 112 can be between about 1 and about 3 times the gripping distance 174 between central axes 156, 158. The widest cross-section 170 of the housing 112 can be between 1.9 and 2.1 times the gripping distance 174 between central axes 156, 158. The design dimensions and ratios are contemplated to improve ergonomic use of the pipette system 102, as well as retain the housing 112 dimensions in such a way to accommodate various components including, e.g., a three-digit counter 100, four-digit counter 20, or an electronic counter. The button extension distance 164 can be between about 1.8 and about 2.4 times the gripping distance 174 between central axes 156, 158. The button extension distance 164 can be between 1.8 and 2.4 times the gripping distance 174 between central axes 156, 158.

Figure 18:
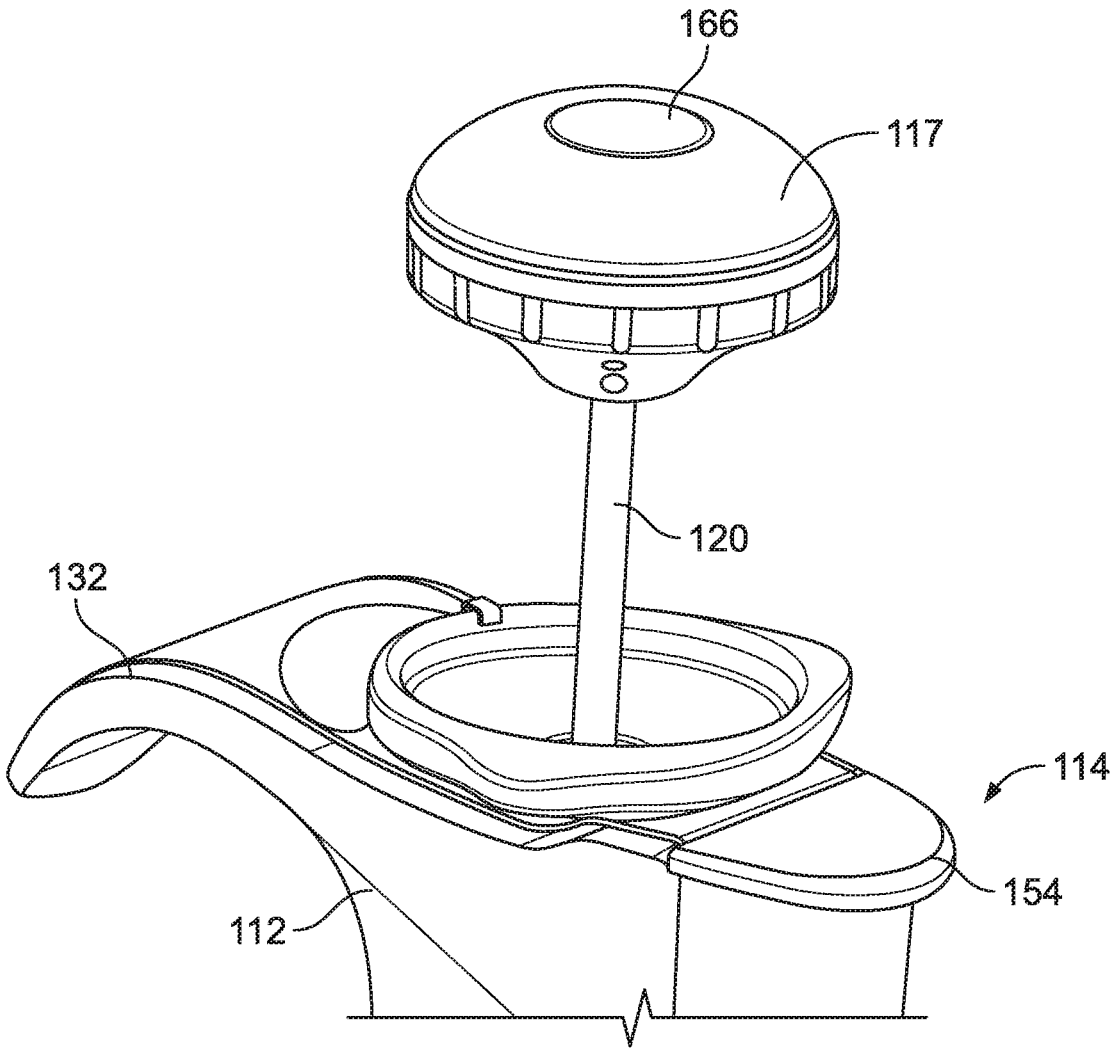
FIG. 18 shows a partial top isometric view of a pipette system having a control button according to another embodiment.
Figure 19:
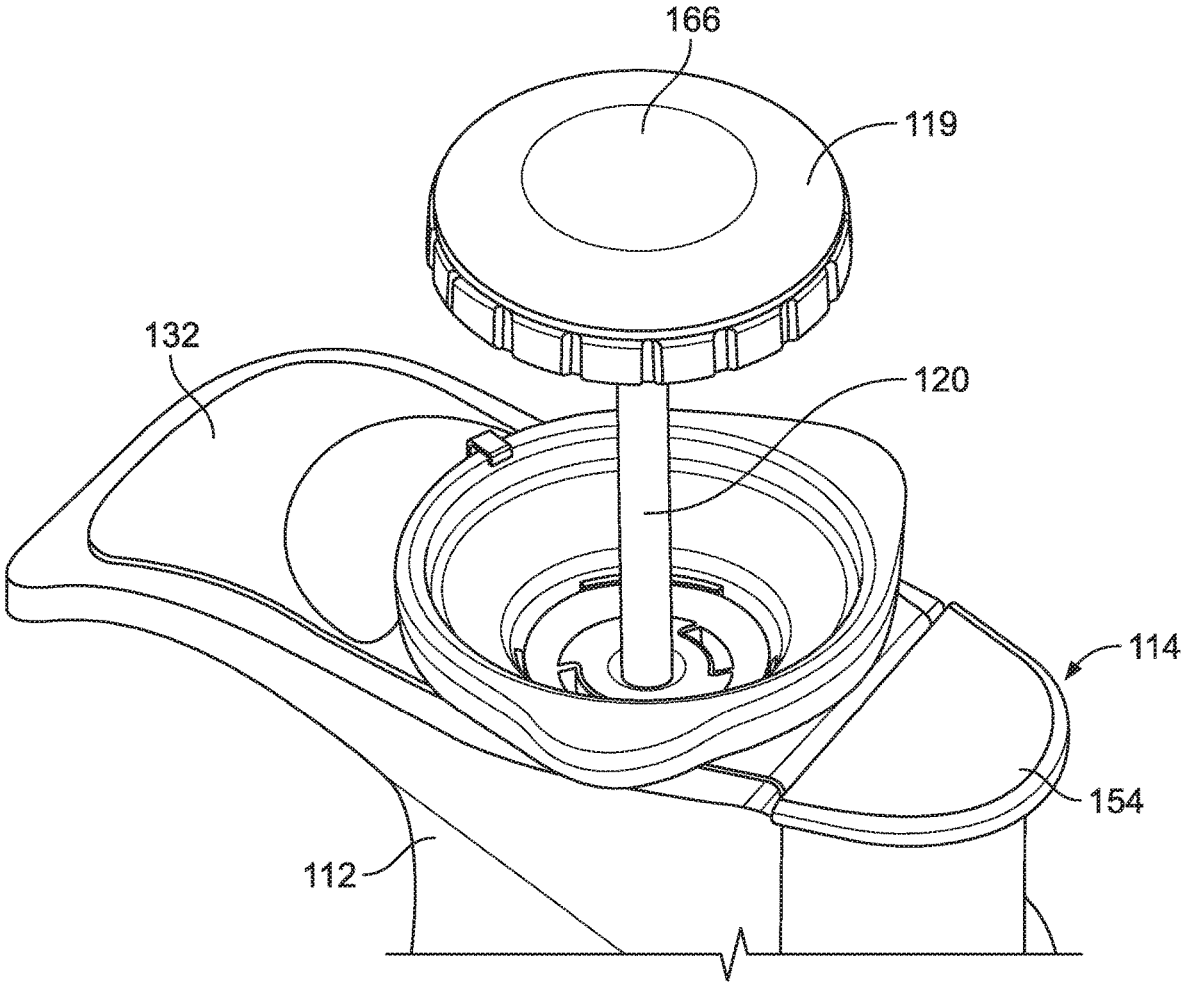
FIG. 19 shows a partial top isometric view of a pipette system having a control button according to a further embodiment.
Figure 20:
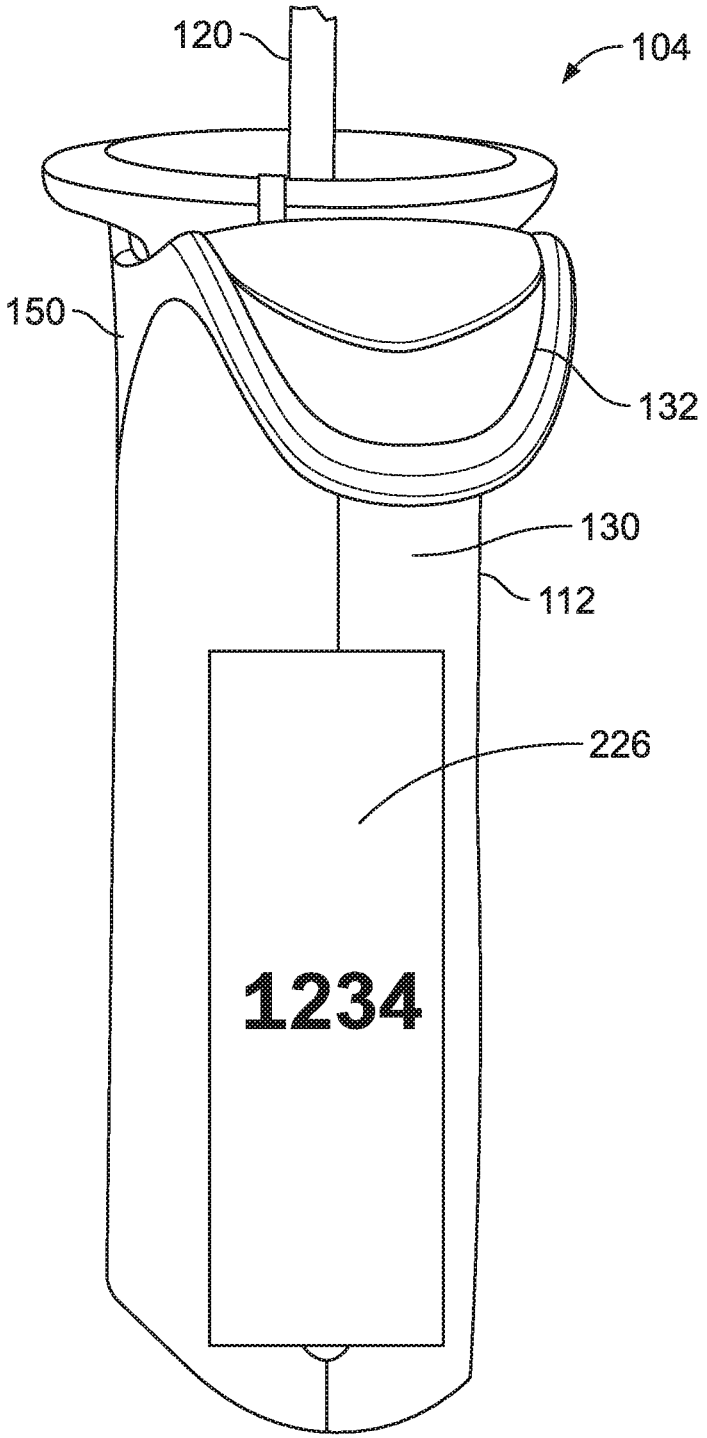
FIG. 20 shows a partial front elevational view of a pipette system utilizing an electronic counter.

As further shown in FIGS. 18 and 19, different control button configurations can be used with the pipette 1. Because each control button configuration creates a different button extension distance 164, the ratios discussed above may change depending on the control button used with the pipette 1. For example, for a rounded control button 117 as shown FIG. 18, the widest cross-section 170 can be between about 0.7 and about 1.2 times the button extension distance 164. The widest cross-section 170 can be between 0.8 and 1 times the button extension distance 164. The button extension distance can be about 2 and about 3 times the gripping distance 174 between central axes 156, 158, and the button extension distance can be about 3 and about 4 times the length of the radius of curvature 134. The button extension distance can be between 2.0 and 2.5 times the gripping distance 174 between central axes 156, 158, and the button extension distance can be between 3.4 and 3.6 times the length of the radius of curvature 134.

To achieve a substantially flat control button 119 as shown in FIG. 19, the widest cross-section 170 can be between about 1 and about 2 times the button extension distance 164. The widest cross-section 170 can be between about 0.9 and about 1.2 times the button extension distance 164. The button extension distance can be between about 1 and about 2 times the gripping distance 174 between central axes 156, 158. The button extensions distance can be between about 2.5 and about 3.5 times the length of the radius of curvature 134. The button extension distance can be between 1.7 and 1.9 times the gripping distance 174 between central axes 156, 158. The button extensions distance can be between 2.6 and 2.9 times the length of the radius of curvature 134. In some embodiments, the control button includes one or more of an electronic device, a switch, a control means, and an electrical power supply to detect and wireless transmit information signals by wireless link, or any other modifications disclosed in U.S. Pat. No. 9,440,230, PCT Publication WO 2016/207131, and PCT Publication WO 2018/069611, which are all hereby incorporated by reference in their entirety.

Some embodiments provide a method of manufacturing and assembling the pipette system disclosed herein. The method includes receiving a housing defining an interior space and a hook, the hook extending away from a central axis of the housing at a radius of curvature. Further, the interior space of the housing is dimensioned to receive a plurality of different volume counters, but only one counter at a time. A control button is provided and coupled to a control shaft and an ejector. The control button, ejector, and housing are assembled so that the control shaft extends away from a control end of the housing and the ejector is coupled to the body.

The control shaft, ejector and housing can also be assembled so that the widest cross-section of the housing is between about 1 and about 4 times the radius of curvature of the hook. The control shaft, ejector, and housing can also be assembled so that the widest cross-section of the housing is between 2 to 3 times the radius of curvature of the hook. The control shaft, ejector and housing can also be assembled so that the widest cross-section of the housing is between 2.9 to 3.2 times the radius of curvature of the hook. Additionally, a distance from the control end of the housing to a top of the control button, when the pipette is adjusted to its nominal volume (e.g. the maximum volume), is between about 1 and about 4, 2 to 4, or 2.7 to 3.6 times the length of the radius of curvature of the hook. A distance from a central axis of the ejector to a central axis of the control button is between about 0.1 and about 3, or between about 1 and about 2, or between about 1.4 and about 1.6 times the length of the radius of curvature. The widest cross-section of the housing can be between about 1 and about 3 times the gripping distance 174 between central axes. The widest cross-section of the housing can be between about 1.9 and about 2.1 times the gripping distance 174 between central axes.

A number of different volume counters can be installed into the housing, such as a three-digit counter, a four-digit counter, or an electronic counter. More specifically, for at least one type of in-use configuration, a three-digit counter is installed, and for another type of in-use configuration, a four-digit counter is installed. A further in-use configuration is provided in the form of the pipette system having an electronic counter. A spacer having a substantially cylindrical side wall and a base can form a counter space sized and shaped to receive a three-digit counter. The method of assembling the pipette system can include the step of inserting the three-digit counter into the counter space of the spacer to mechanically couple the spacer to the three-digit counter. The combination of the three-digit counter and the spacer can then be inserted through an opening in the housing into the interior space, and secured in the housing by coupling a window guide.

In some embodiments, the pipette system 102 may be provided in the form of a kit during manufacturing, which may include one or more of the components listed above. In particular, in addition to the body 104, a kit for assembling the pipette system 102 may include the three-digit counter 100, the spacer 124, and the window guide 122. In some embodiments, the kit may include the four-digit counter 20 and a partially transparent window 144. In some embodiments, the kit may include the three-digit counter 100, the spacer 124, the window guide 122, and the position selector 82 that is displaced in rotation according to the axis 12 among three positions. In some embodiments, the kit may include the four-digit counter 20 and the position selector 82.

In some embodiments, a four-digit counter can be inserted into the housing rather than the three-digit counter. The four-digit counter, similarly, is inserted into the opening in the housing, and is received into the interior space. A window guide, which has a window sized to display the numbering of a four-digit counter is then coupled to the housing by way of the opening to secure the four-digit counter into the interior space.

In this way, a single pipette housing can be made in a manufacturing process. The pipette housing can then receive either the three-digit counter and its associated components, the four-digit counter and its components, or the electronic counter and its associated components.

Any of the embodiments described herein may be modified to include any of the structures or methodologies disclosed in connection with different embodiments. Further, the present disclosure is not limited to air-displacement or positive displacement pipettes of the type specifically shown.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the disclosure and to teach the best mode of carrying out same. The exclusive rights to all modifications which come within the scope of the appended claims are reserved.

I claim:

1. A pipette system for transporting a measured volume of liquid, the pipette system comprising:

a body including a housing defining an interior space; and an elongate opening positioned in a front wall of the housing, wherein the interior space is configured to receive one of a plurality of volume counters without modification of the housing, and wherein the plurality of volume counters includes a first counter and a second counter different than the first counter.

2. The pipette system of claim 1, wherein the opening is configured to receive and retain a plurality of window guides by an interference fit.

3. The pipette system of claim 1, wherein the first counter has a first number of digits and the second counter has a second number of digits different than the first number of digits.

4. The pipette system of claim 3, wherein the first number of digits is three and the second number of digits is four, the first counter including an insertable spacer, the first counter configured to mechanically attach to the insertable spacer.

5. The pipette system of claim 1, wherein the first counter is configured to be coupled with a first set of interior adjustment parts, wherein the second counter is configured to be coupled with a second set of interior adjustment parts different than the first set of interior adjustment parts, and wherein the interior space of the housing has a size, shape, and volume to interchangeably retain the first set of interior adjustment parts or the second set of interior adjustment parts without modification of an exterior portion of the housing.

6. The pipette system of claim 5, wherein the first set of interior adjustment parts is controlled by a selector control button.

7. The pipette system of claim 6, wherein the selector control button provides adjustment positions including one or more of a free adjustment position, a fine adjustment position, and a latched position.

8. The pipette system of claim 1 further including a lever that contacts an ejector, the lever being movably coupled to an interior adjustment part.

9. A method of manufacturing a pipette system that includes the steps of:

providing a housing that is configured to receive a first volume counter or a second volume counter, the first volume counter being different than the second volume counter;

providing a first set of interior adjustment parts that is configured to be coupled with the first volume counter or providing a second set of interior adjustment parts that is configured to be coupled with the second volume counter;

assembling the first set of interior adjustment parts or the second set of interior adjustment parts within the housing; and inserting the first volume counter or the second volume counter into a cavity defined by the housing.

10. The method of claim 9 further comprising the step of:

providing an ejector system with the housing, the ejector system including a lever.

11. The method of claim 9, wherein the first set of interior adjustment parts are only configured to be coupled with the first volume counter, and the second set of interior adjustment parts are only configured to be coupled with the second volume counter.

12. The method of claim 9, wherein the second volume counter is larger in size than the first volume counter.

13. The method of claim 9, wherein the first set of interior adjustment parts are configured to be coupled with the first volume counter or with the second volume counter.

14. The method of claim 9, wherein the opening is configured to receive and retain a first window guide or a second window guide that is different than the first window guide.

15. The method of claim 9 further comprising the step of providing a position selector that is displaced in rotation among at least three positions, wherein the position selector is one of the first or second interior adjustment parts.

16. A kit for assembling a pipette system that includes:

a body including a housing defining an interior space, the body defining a housing with an elongate opening positioned in a front wall of the housing;

a first volume counter configured to be inserted into the body or a second volume counter configured to be inserted into the body; and a first set of interior adjustment parts configured to be coupled with the first volume counter or a second set of interior adjustment parts configured to be coupled with the second volume counter, wherein the opening is configured to receive the first volume counter into the interior space or the second volume counter into the interior space without modification of the housing.

17. The kit of claim 16 further comprising:

a spacer configured to be coupled with the first volume counter.

18. The kit of claim 16, further comprising an ejector system with the housing, the ejector system being configured for coupling with the body.

19. The kit of claim 18, wherein the ejector system includes a lever.

20. The kit of claim 16 further comprising a position selector that is displaced in rotation among at least three positions, wherein the position selector is one of the first or second interior adjustment parts.

* * * * *